US008406654B2

(12) United States Patent
Igarashi

(10) Patent No.: US 8,406,654 B2
(45) **Date of Patent: *Mar. 26, 2013**

(54) IMAGE FORMING APPARATUS

(75) Inventor: Hiroshi Igarashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/221,580

(22) Filed: Aug. 30, 2011

(65) Prior Publication Data

US 2011/0311275 A1 Dec. 22, 2011

Related U.S. Application Data

(63) Continuation of application No. 12/648,032, filed on Dec. 28, 2009, now Pat. No. 8,027,614.

(30) Foreign Application Priority Data

Dec. 26, 2008 (JP) ..... 2008-333157
Jun. 26, 2009 (JP) ..... 2009-152613

(51) Int. Cl.
*G03G 15/00* (2006.01)

(52) U.S. Cl. ..... 399/110; 399/302; 399/303; 399/308

(58) Field of Classification Search ..... 399/107, 399/110, 116, 117, 297, 299, 300, 302, 303, 399/306, 308
See application file for complete search history.

(56) References Cited

U.S. PATENT DOCUMENTS 5,745,825 A 4/1998 Okawa et al.
5,765,082 A 6/1998 Numazu et al.
6,385,425 B1 5/2002 Tanaka
6,453,135 B1 9/2002 Sameshima et al.
7,162,192 B2 1/2007 Yamada et al.
2003/0161656 A1 8/2003 Miura et al.
2005/0152716 A1 7/2005 Agata et al.
2005/0244197 A1 11/2005 Sasamoto et al.

(Continued)

FOREIGN PATENT DOCUMENTS

JP H04-341873 A 11/1992
JP H09-006088 A 1/1997

(Continued)

OTHER PUBLICATIONS

The State Intellectual Property Office of the People's Republic of China, the First Office Action for Chinese Patent Application No. 200910217271.1 (counterpart to above-captioned patent application), mailed Sep. 15, 2011.

(Continued)

*Primary Examiner* — Hoan Tran
(74) *Attorney, Agent, or Firm* — Baker Botts L.L.P.

(57) ABSTRACT

An image forming apparatus includes: a plurality of photosensitive members, an endless belt, and a separation mechanism. The photosensitive members are arranged in parallel with and spaced from one another and correspond to respective colors. The plurality of photosensitive members includes a first photosensitive member and at least one second photosensitive member. Each of the photosensitive members has a first end portion and second end portion that is opposite to the first end portion in a longitudinal direction of each of the photosensitive members. The endless belt contacts the photosensitive members. The separation mechanism is configured to swing the second photosensitive member around the first end portion of the second photosensitive member as a fulcrum between a contact position at which the second photosensitive member contacts the endless belt and a separated position at which the second photosensitive member is separated from the endless belt.

14 Claims, 23 Drawing Sheets

U.S. PATENT DOCUMENTS

| | | | | |
|---|---|---|---|---|
| 2006/0093395 | A1* | 5/2006 | Igarashi et al. | 399/101 |
| 2006/0280520 | A1 | 12/2006 | Inada | |

FOREIGN PATENT DOCUMENTS

| | | | |
|---|---|---|---|
| JP | H09-281770 | A | 10/1997 |
| JP | H10-239944 | A | 9/1998 |
| JP | 2001-117314 | A | 4/2001 |
| JP | 2001-142378 | A | 5/2001 |
| JP | 2001-166602 | A | 6/2001 |
| JP | 2002-006716 | A | 1/2002 |
| JP | 2003-029498 | A | 1/2003 |
| JP | 2003-233242 | A | 8/2003 |
| JP | 2003-287992 | A | 10/2003 |
| JP | 2004-258440 | A | 9/2004 |
| JP | 2005-222035 | A | 8/2005 |
| JP | 2006-349702 | A | 12/2006 |
| JP | 2008-089661 | A | 4/2008 |

OTHER PUBLICATIONS

European Patent Office; Search Report in European Application No. 0180819.6 (counterpart to the above-captioned U.S. patent application), mailed Mar. 22, 2010. (Submitted with Parent).

Japan Patent Office; Notification of Reasons for Refusal for Patent Application No. JP2008-333157 (counterpart to above-captioned U.S. patent application), dated Oct. 26, 2010. (Submitted with Parent).

Japan Patent Office; Decision of Patent Grant for Japanese Patent Application No. 2008-333157 (counterpart to above-captioned patent application), dispatched Jun. 7, 2011. (Submitted with Parent).

Japan Patent Office, Office Action for Japanese Patent Application No. 2009-152613 (counterpart to above-captioned patent application), dated Apr. 19, 2011. (Submitted with Parent).

* cited by examiner

IMAGE FORMING APPARATUS

CROSS-REFERENCE TO RELATED APPLICATIONS

This application is a continuation application of U.S. patent application Ser. No. 12/648,032, filed Dec. 28, 2009; which claims the priority of Japanese Patent Application No. 2008-333157, filed Dec. 26, 2008; and Japanese Patent Application No. 2009-152613, filed Jun. 26, 2009, the entire contents of which are incorporated herein by reference.

TECHNICAL FIELD

The present invention relates to an image forming apparatus such as an electrophotographic color printer.

BACKGROUND

An image forming apparatus such as an electrophotographic color printer of a tandem type includes: photosensitive members corresponding to four colors, i.e., black, yellow, magenta and cyan, respectively; and a conveying belt opposing the photosensitive members.

However, the photosensitive members always contact the conveying belt. Consequently, for example, even when a monochrome image is formed, the remaining photosensitive members not used for an image formation, i.e., of yellow, magenta and cyan may deteriorate.

A color image recording apparatus is proposed as an example of image forming apparatus for preventing such deterioration of the photosensitive member. The color image recording apparatus includes: one color image forming unit containing image forming units of yellow, magenta and cyan; and another unit containing an image forming unit of black. In the color image recording apparatus, when a monochrome image is formed, the color image forming unit is separated from a conveying belt.

SUMMARY

The above-described color image recording apparatus includes an eccentric cam configured to push or release a press on the color image forming unit so as to move the color image forming unit up and down.

Specifically, the color image forming unit is moved up by pushing the color image forming unit by the eccentric cam from below, whereby the photosensitive member is separated from the conveying belt. Further, the color image forming unit is moved down by releasing the press on the eccentric cam, whereby the photosensitive member contacts the conveying belt.

The configuration for moving the color image forming unit up and down includes the eccentric cam and a complex gear train, which complicates the configuration for allowing the photosensitive member to contact and be separated from the conveying belt.

The present invention was made in view of the above circumstances, and an object thereof is to provide an image forming apparatus with a simplified configuration capable of separating a photosensitive member from an endless belt.

According to an aspect of the invention, there is provided an image forming apparatus comprising: a plurality of photosensitive members arranged along an arrangement direction so as to be in parallel with and spaced from one another and corresponding to respective colors, the plurality of photosensitive members comprising a first photosensitive member and at least one second photosensitive member, and each of the plurality of photosensitive members having a first end portion and second end portion that is opposite to the first end portion in a longitudinal direction of each of the plurality of photosensitive members; an endless belt that contacts the plurality of photosensitive members; and a separation mechanism configured to swing the second photosensitive member around the first end portion of the second photosensitive member as a fulcrum between a contact position at which the second photosensitive member contacts the endless belt and a separated position at which the second photosensitive member is separated from the endless belt.

DESCRIPTION

Exemplary embodiments of the present invention will be described with reference to FIGS. 1 to 26. Color printers 1 and 201 are shown in FIGS. 1 to 26 as an example of an image forming apparatus according to exemplary embodiments of the preset invention. For ease of discussion, in the following description, directions are defined as viewed from a user who operates the color printer 1 or 201. The top or upper side, the bottom or lower side, the left or left side, the right or right side, the front or front side, and the rear or rear side of the printer 1 or 201 are identified as indicated by the arrows in drawings. Further, herein the left-right direction is also referred to as a width direction or a lateral direction. With regard to various individual components of the printer 1 or 201, sides of the individual components are similarly identified based on the arranged/attached position of the components on/in the printer 1.

1. First Exemplary Embodiment

1.1. Overview of Color Laser Printer

Figure 1:
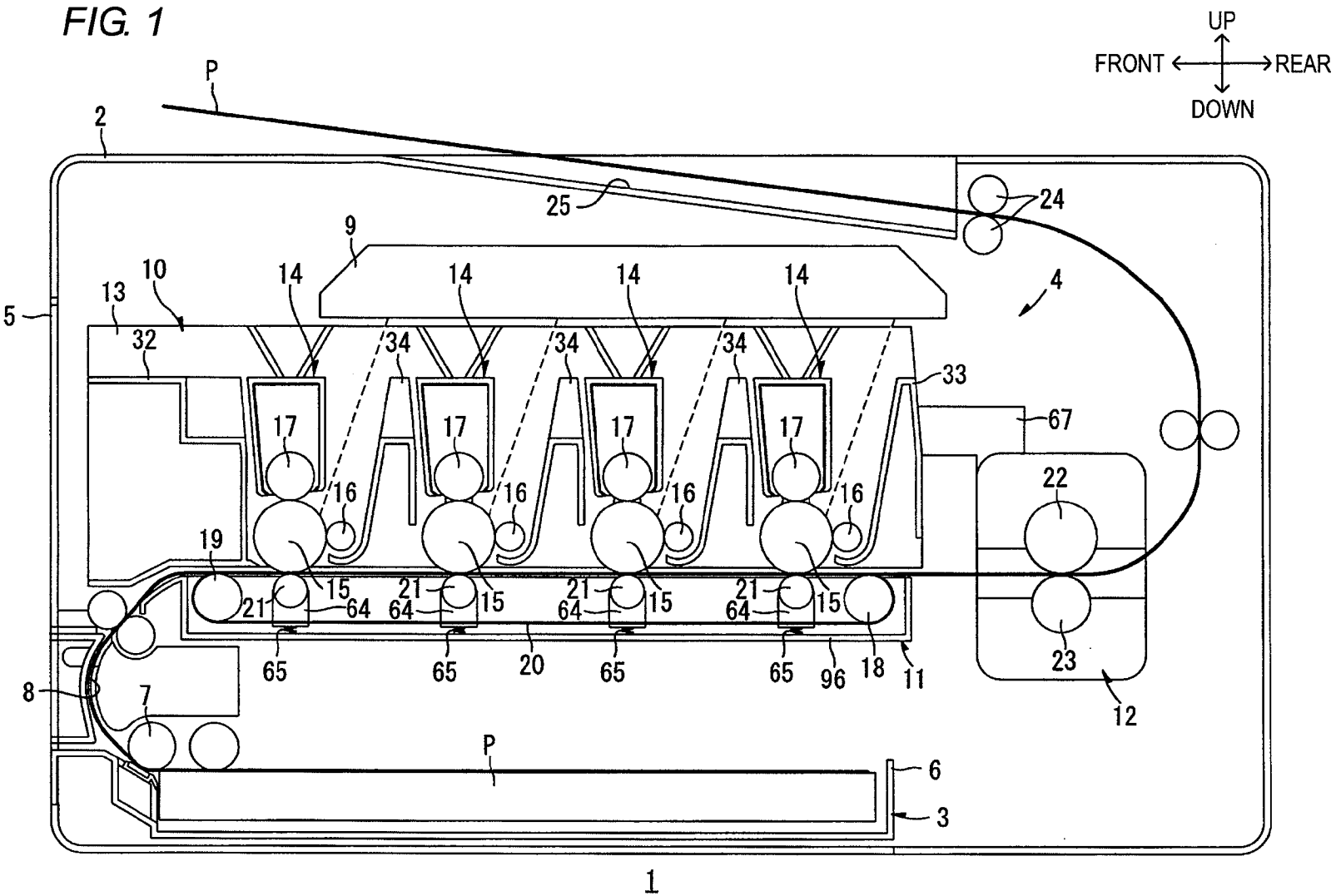
FIG. 1 is a side cross-sectional view showing a color laser printer as an example of an image forming apparatus according to a first exemplary embodiment of the invention.

As shown in FIG. 1, a color printer 1 of a first exemplary embodiment is a transverse-mounted tandem color laser printer. The color printer 1 includes a main body casing 2. The color printer 1 further includes, in the main body casing 2, a sheet feeding unit 3 configured to feed a sheet and an image forming unit 4 configured to form an image on the sheet P fed by the sheet feeding unit 3.

(1) Main Body Casing

The main body casing 2 has a substantially box shape which is substantially rectangular in side view and which stores the image forming unit 4. A front side wall of the main body casing 2 includes a front cover 5 movable between an open position and a close position. When the front cover 5 is in the open position, a process unit 10 can be attached to and detached from the color printer 1.

(2) Sheet Feeding Unit

The sheet feeding unit 3 includes a sheet feeding tray 6 configured to store sheets P. The sheet feeding tray 6 is removably attached to a bottom area in the main body casing 2. Above a front end of the sheet feeding tray 6, a sheet feeding roller 7 and a sheet feeding path 8 are disposed. The sheet feeding path 8 includes a U-turn path.

The sheets P stored in the sheet feeding tray 6 are fed one at a time toward the sheet feeding path 8 by rotation of the sheet feeding roller 7. Subsequently, the sheet P is conveyed from the sheet feeding path 8 toward the image forming unit 4 (specifically, between photosensitive drums 15 and a conveying belt 20). The number of photosensitive drums 15 is, for example, four.

(3) Image Forming Unit

The image forming unit 4 includes a scanner unit 9, a process unit 10 as an example of a photosensitive unit, a transfer unit 11, and a fixing unit 14.

(3-1) Scanner Unit

The scanner unit 9 is disposed in an upper portion of the main body casing 2. As indicated by a broken line in FIG. 1, the scanner unit 9 emits laser beams based on image data toward the four photosensitive drums 15, thereby exposing the photosensitive drums 15.

(3-2) Process Unit (3-2-1) Configuration of Process Unit

The process unit 10 is disposed at a position below the scanner unit 9 and above the sheet feeding unit 3. The process unit 10 includes one process frame 13 and a plurality of, e.g., four, developer cartridges 14 corresponding to respective colors.

The process frame 13 is movable along a front-rear direction relative to the main body casing 2 so as to be inserted into and pulled out from an inside of the main body casing 2 when the front cover 7 is in the open position. Accordingly, the process unit 12 is removably attached to the main unit casing 2. The process frame 13 stores the photosensitive drums 15 and charging rollers 16.

The (four) photosensitive drums 15 are arranged along the right-left direction and spaced from each other in the front-rear direction, so as to correspond to respective colors, i.e., black, yellow, magenta and cyan from the front side toward the rear side. As used herein, the photosensitive drums 15 of respective colors are also referred to as a black photosensitive drum 15, a yellow photosensitive drum 15, a magenta photosensitive drum 15, and a cyan photosensitive drum 15.

The charging rollers 16 are disposed adjacent to the respective photosensitive drums 15 on the rear sides of the photosensitive drums 15.

The developer cartridges 14 are disposed adjacent to and on the upper sides of the respective photosensitive drums 15. Each of the developer cartridges 14 includes a developing roller 17.

The developing roller 17 is rotatably supported to the developer cartridge 14 so as to expose from a lower end of the developer cartridge 14 and to contact the photosensitive drum 15 from the upper side thereof.

Although not shown, each of the developer cartridges 14 includes a supply roller configured to supply toner to the developing roller 17, and a layer thickness regulating blade configured to regulate a thickness of the toner supplied to the developing roller 17. Further, each of the developer cartridges 14 accommodates toner of a corresponding color in a space above the supply roller and the layer thickness regulating blade.

(3-2-2) Developing Operation of Process Unit

Toner accommodated in the developer cartridge 14 is supplied to the supply roller (not shown) and further to the developing roller 17, and then positively charged through friction between the supply roller (not shown) and the developing roller 17.

The thickness of the toner supplied to the developing roller 17 is regulated by a layer thickness regulating blade (not shown) in association with rotation of the developing roller 17, and the toner is carried on the surface of the developing roller 17 as a thin layer of given thickness.

Surfaces of the photosensitive drums 15 are uniformly positively charged by the respective charging rollers 16 along with rotation of the respective photosensitive drums 15. Subsequently, the surfaces of the photosensitive drums 15 are exposed to laser beams (see broken lines in FIG. 1) originating from the scanner unit 9 through high speed scan. An electrostatic latent image corresponding to an image to be formed on the sheet P is thereby formed on the surfaces of the respective photosensitive drums 15.

When the photosensitive drums 15 further rotate, the positively-charged toner held on the surfaces of the developing rollers 17 is supplied to the electrostatic latent images formed on the respective surfaces of the photosensitive drums 15. The electrostatic latent images of the photosensitive drums 15 are thereby made visible, whereupon toner images formed by reversal development are held on the surfaces of the photosensitive drums 15 corresponding to the respective colors.

(3-3) Transfer Unit

The transfer unit 11 is disposed along the front-rear direction within the main unit casing 2 at a position above the sheet feeding unit 3 and at a position below the process unit 10. The transfer unit 11 includes: a drive roller 18; a driven roller 19; a conveyor belt 20 serving as an example of an endless belt which contacts the photosensitive drums 15; and transfer rollers 21 serving as an example of transfer members.

The drive roller 18 and the driven roller 19 are arranged to oppose and to be spaced from each other in the front-rear direction. The conveyor belt 20 includes an endless belt that passes around the drive roller 18 and the driven roller 19.

The transfer rollers 21 are arranged in parallel and spaced from one another so as to oppose the respective photosensitive drums 15 with the conveyor belt 20 sandwiched therebetween.

The sheet P fed from the sheet feeding unit 3 is conveyed from the front side to the rear side by means of the conveyor belt 20 so as to sequentially pass through the space between each of the photosensitive drums 15 and a corresponding one of the transfer rollers 21. During conveyance of the sheet P, the toner images of respective colors held on the respective photosensitive drums 15 are sequentially transferred, thereby a color image is produced on the sheet P.

(3-4) Fixing Unit

A fixing unit 12 is arranged on the rear side of the transfer unit 11 and includes a heating roller 22 and a press roller 23 opposing the heating roller 22. In the transfer unit 11, the color image transferred to the sheet P is thermally fixed on the sheet P by heating and pressurization while the sheet P passes through the heating roller 22 and the press roller 23.

(4) Sheet Output

The sheet P having the toner image fixed thereon is conveyed through a U-turn sheet output path (not shown) toward sheet output rollers 24 and output on a sheet output tray 25 formed in an upper surface of the main unit casing 2 by means of the sheet output rollers 24.

1.2. Details of Process Unit

Figure 2:
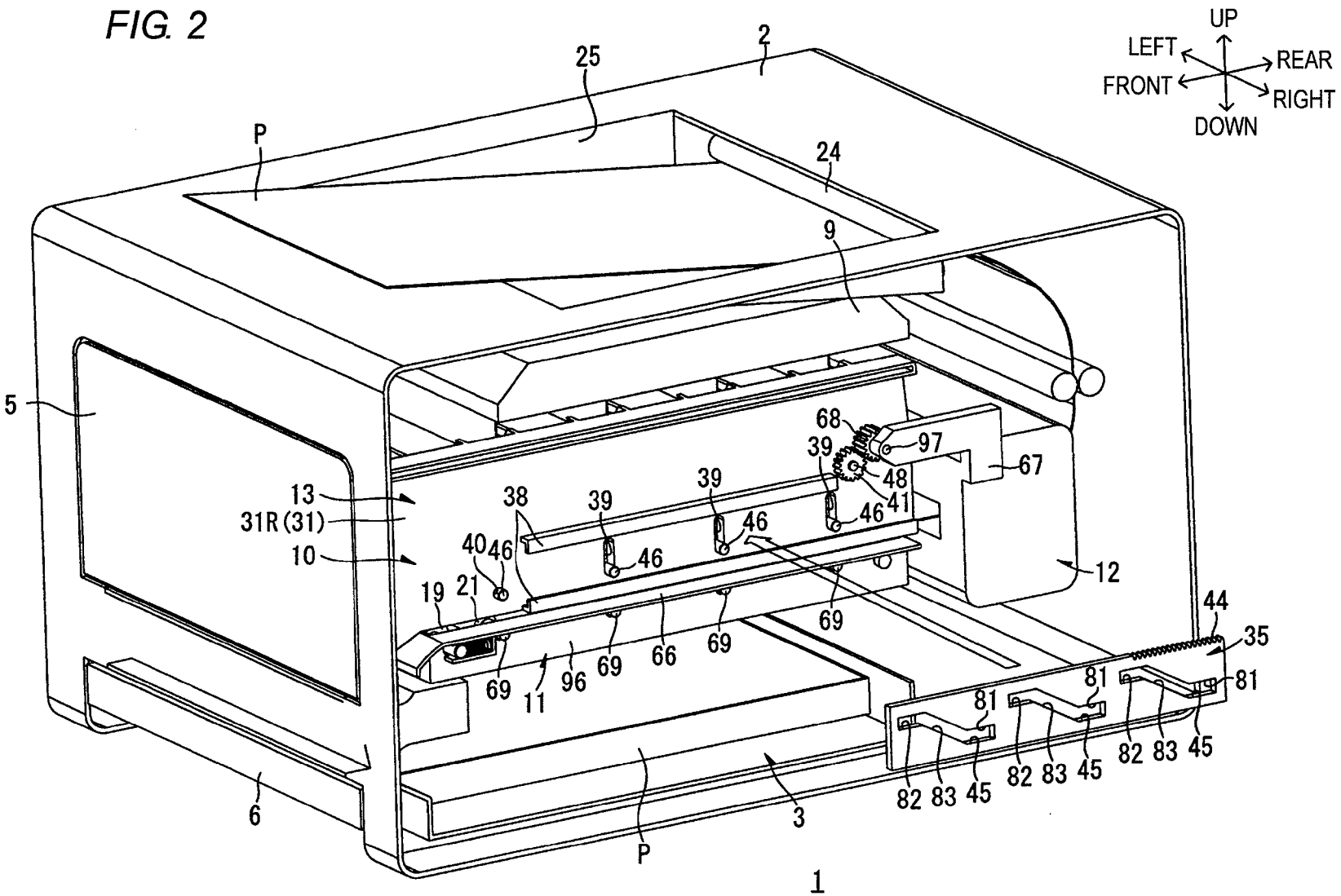
FIG. 2 is a diagram showing the color laser printer shown in FIG. 1.
Figure 3:
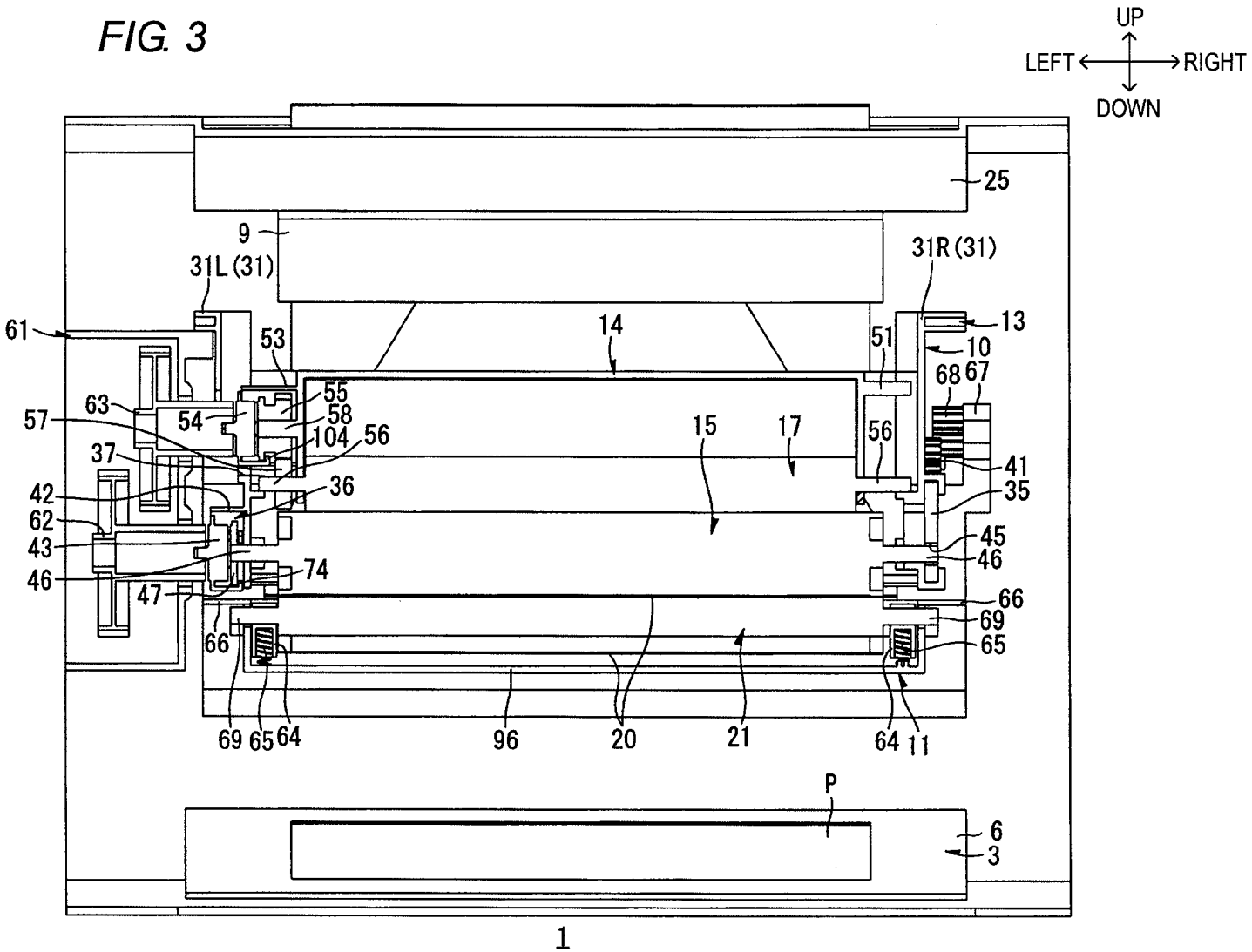
FIG. 3 is a front cross-sectional view of the color laser printer shown in FIG. 1.

As shown in FIGS. 1 and 3, the process frame 13 includes: a pair of side plates 31 laterally spaced from and opposing each other; a front beam 32, a rear beam 33 and a plurality of, e.g., three, partition plates 34, which extend between the side plates 31; and a translation cam 35 (see FIG. 2) serving as an example of a reciprocating member. The process frame 13 supports the photosensitive drums 15.

Each of the side plates 31 has a substantially rectangular shape in side view and is disposed outside the conveyor belt 20. As used herein, when the right side and left side are identified for the side frames 31, one of the side plates 31 which is located on the right side is referred to as a right side plate 31R, and the other of the side plates 31 which is located on the left side is referred to as a left side plate 31L.

As shown in FIG. 2, the right side plate 31R includes: a pair of vertically-spaced translation cam supporting portions 38; drum shaft guide grooves 39 serving as a second guide portion; and a black drum shaft inserting hole 40. Further, the right side plate 31R includes a relay gear 41.

Each of the translation cam supporting portions 38 is a protrusion formed on a right surface of the right side plate 31R so as to extend in the front-rear direction, and having a substantially L-shape in cross section. The translation cam supporting portions 38 are disposed spaced from and oppose each other in the up-down direction.

The upper one of translation cam supporting portions 38 protrudes rightward from the right surface of the right side plate 31R and then is bent downward. The upper translation cam supporting portion 38 is disposed at a substantially center portion of the right side plate 31R in the front-rear direction and the up-down direction. A rear end portion of the upper translation cam supporting portion 38 is disposed above a drum shaft 46 of the photosensitive drum corresponding to cyan, and a front end portion of the upper translation cam supporting portion 38 is disposed above and on a front side of a drum shaft of the yellow photosensitive drum 15.

A lower one of the translation cam supporting portions 38 protrudes rightward from a lower end of the right surface of the right side plate 31R and then is bent upward. A rear end portion of the lower translation cam supporting portion 38 is disposed at a rear end of the right side plate 31R, and a front end portion of the lower translation cam supporting portion 38 is disposed below and on a front side of the drum shaft of the yellow photosensitive drum 15.

The drum shaft guide grooves 39 are arranged spaced from and in parallel with one another along the front-rear direction so as to correspond to the drum shafts 46 of the yellow, magenta and cyan photosensitive drums 15. Each of the drum shaft guide groove 39 is disposed between the upper and lower translation cam supporting portions 38 and formed as an elongated hole having a length in the up-down direction substantially the same as a distance between the upper and lower translation cam supporting portions 38 in the up-down direction.

The black drum shaft inserting hole 40 is disposed on a rear side of the translation cam supporting portions 38 so as to correspond to the drum shaft 46 of the black photosensitive drum 15. The black drum shaft inserting hole 40 has a substantially ellipsoidal shape in side view so as to accept the drum shaft 46 of the black photosensitive drum 15.

The relay gear 41 is disposed on a rear side of the upper translation cam supporting portion 38, and rotatably supported by a relay gear supporting shaft 48 protruding rightward from the right surface of the right side plate 31R.

Figure 5:
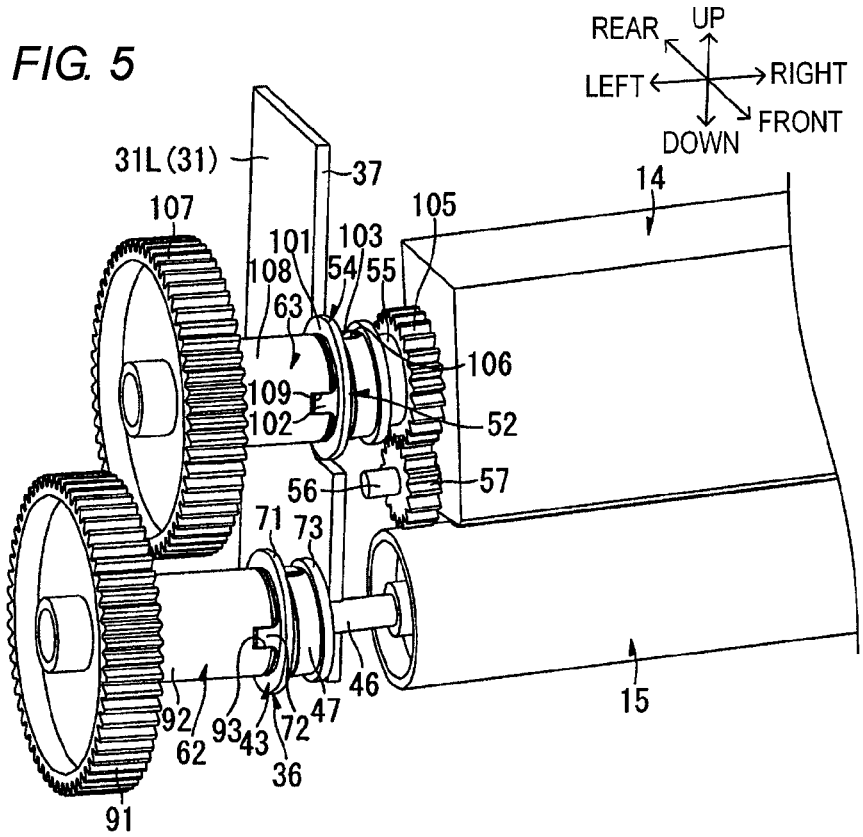
FIG. 5 is a diagram explaining a swing movement of the photosensitive drum shown in FIG. 4 and showing a state in which a drum protrusion extends along an up-down direction.

As shown in FIGS. 3 and 5, the left side plate 31L includes: drum coupling portions 36 serving as an example of coupling portion; and developing coupling fitting holes 37.

Figure 8:
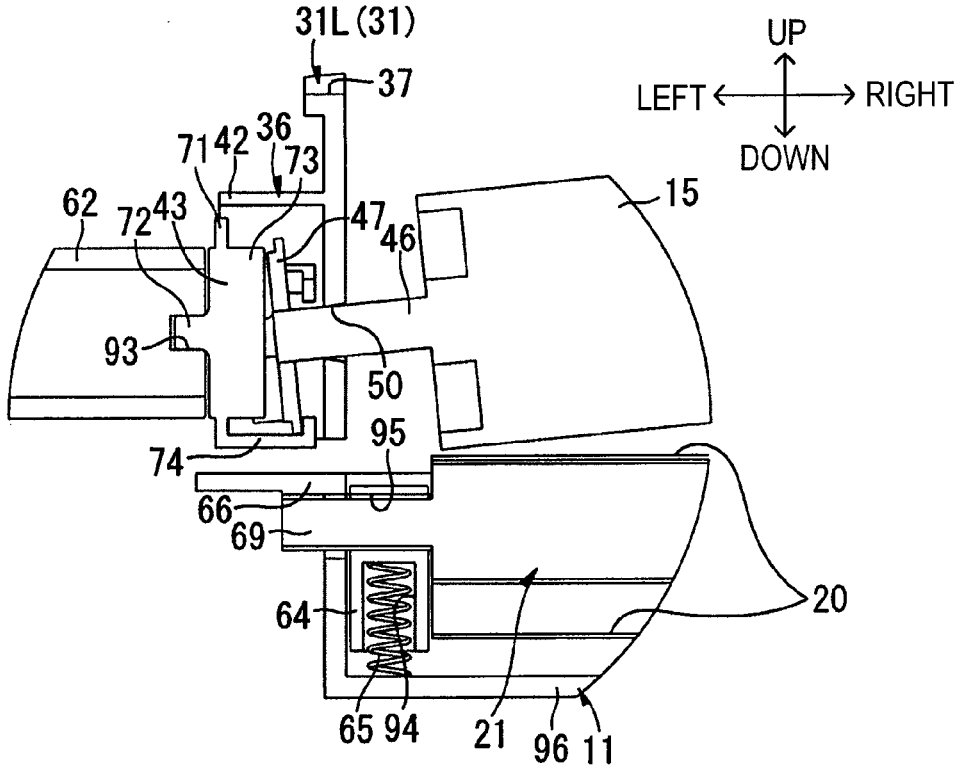
FIG. 8 is an enlarged view of a left end portion of the photosensitive drum shown in FIG. 4.

As shown in FIG. 8, each of the drum coupling portions 36 includes a drum coupling cover 42 and a drum relay coupling 43.

The drum coupling cover 42 has a cylindrical shape protruding leftward from a left surface of the left side plate 31L. In a portion of the left side plate 31L inside the drum coupling cover 42 in left view, a drum shaft inserting hole 50 is formed so as to accept the drum shaft 46.

The drum relay coupling 43 is movably fit in the drum coupling cover 42.

Figure 9:
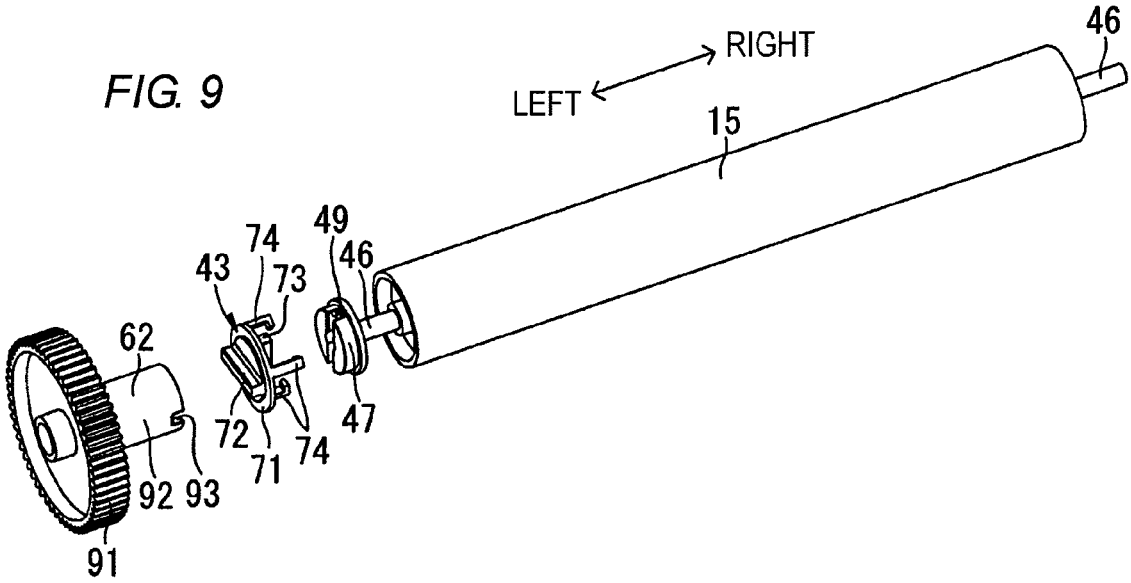
FIG. 9 is an exploded perspective view showing the left end portion of the photosensitive drum shown in FIG. 4.

As shown in FIG. 9, the drum relay coupling 43 includes a base portion 71, a main body protrusion 72, a drum protrusion 73 and a plurality of, e.g., three, hook portions 74 which are integrally formed.

The base portion 71 has a circular disk shape having a diameter slightly smaller than that of the drum coupling cover 42.

The main body protrusion 72 is a protrusion formed on a left surface of the base portion 71 so as to extend along a diameter direction of the base portion 71. The main body protrusion 72 has a length smaller than a diameter of the base portion 71.

The drum protrusion 73 is a protrusion formed on a right surface of the base portion 71 so as to extend perpendicular to the main body protrusion 72 when the drum relay coupling 43 is projected along the right-left direction. The drum protrusion 73 is formed along the diameter direction of the base portion 71 so as to have a length smaller than the diameter of the base portion 71.

Each of the hook portions 74 is arranged on a circumference edge of the base portion 71 so as to be spaced at substantially 120 degrees from adjacent hook portions 74. Each of the hook portions 74 has a hook shape which protrudes rightward from the circumference edge of the base portion 71 and then is bent inward in the diameter direction of the base portion 71.

As shown in FIGS. 3 and 5, the developing coupling fitting holes 37 are formed on and penetrates the left side plate 31L so as to accept respective developing coupling portions 52.

As shown in FIG. 1, the front beam 32 bridges front end portions of the side plates 31 and has a substantially U-shape opened forward in side cross-sectional view.

The rear beam 33 bridges rear end portions of the side plates 31 and has a substantially V-shape opened downward in side cross-sectional view.

The three partition walls 34 are arranged in parallel with and spaced from one another in the front-rear direction, between the front beam 32 and the rear beam 33. Each of the partition walls 34 has a substantially V-shape opened downward in a side cross-sectional view. Consequently, a space defined (enclosed) by the front beam 32, the rear beam 33 and the side plates 31 is partitioned into four regions (substantially equal space) in the front-rear directions by the three partition walls 34.

As shown in FIG. 2, the translation cam 35 is a flat plate in side cross-sectional view. The translation cam includes a rack portion 44 and a plurality of, e.g., three cam grooves 45 serving as a first guide portion.

The rack portion 44 is formed on a rear end portion of an upper surface of the translation cam 35 and has a length slightly longer than that of the cam groove 45 in the front-rear direction, so as to mesh with the relay gear 41.

The cam grooves 45 penetrate the translation cam 35 in the right-left direction, and arranged in parallel with and spaced from one another in the front-rear direction so as to correspond to the respective drum shaft 46. Each of the cam grooves 45 has a substantially crank shape so as to accept the corresponding drum shaft 46.

Specifically, each of the cam grooves 45 includes a continuously formed rear end portion 81 (see FIG. 11), front end portion 82 (see FIG. 12) and inclined portion 83. The rear end portion 81 extends along the front-end direction so as to accept the belt shaft 46 when the photosensitive drum 15 contacts the conveyor belt 20. The front end portion 82 extends along the front-rear direction and is provided above the rear end portion 81 so as to accept the drum shaft 46 when the photosensitive drum 15 is separated from the conveyor belt 20. The inclined portion 83 connects the rear end portion 81 and the front end portion 82 and inclines upward toward front.

As shown in FIG. 9, the drum shaft 46 supporting the photosensitive drum 15 is inserted into the photosensitive drum 15, and a first drum coupling 47 is formed on a left end portion of the drum shaft 46.

The drum shaft 46 is inserted so as to extend coaxially with the photosensitive drum 15 such that a relative rotation between the drum shaft 46 and the photosensitive drum 15 is avoided.

As shown in FIG. 8, the left end portion of the drum shaft 46 is inserted into the drum shaft inserting hole 50 and arranged inside the drum coupling cover 42.

Figure 10:
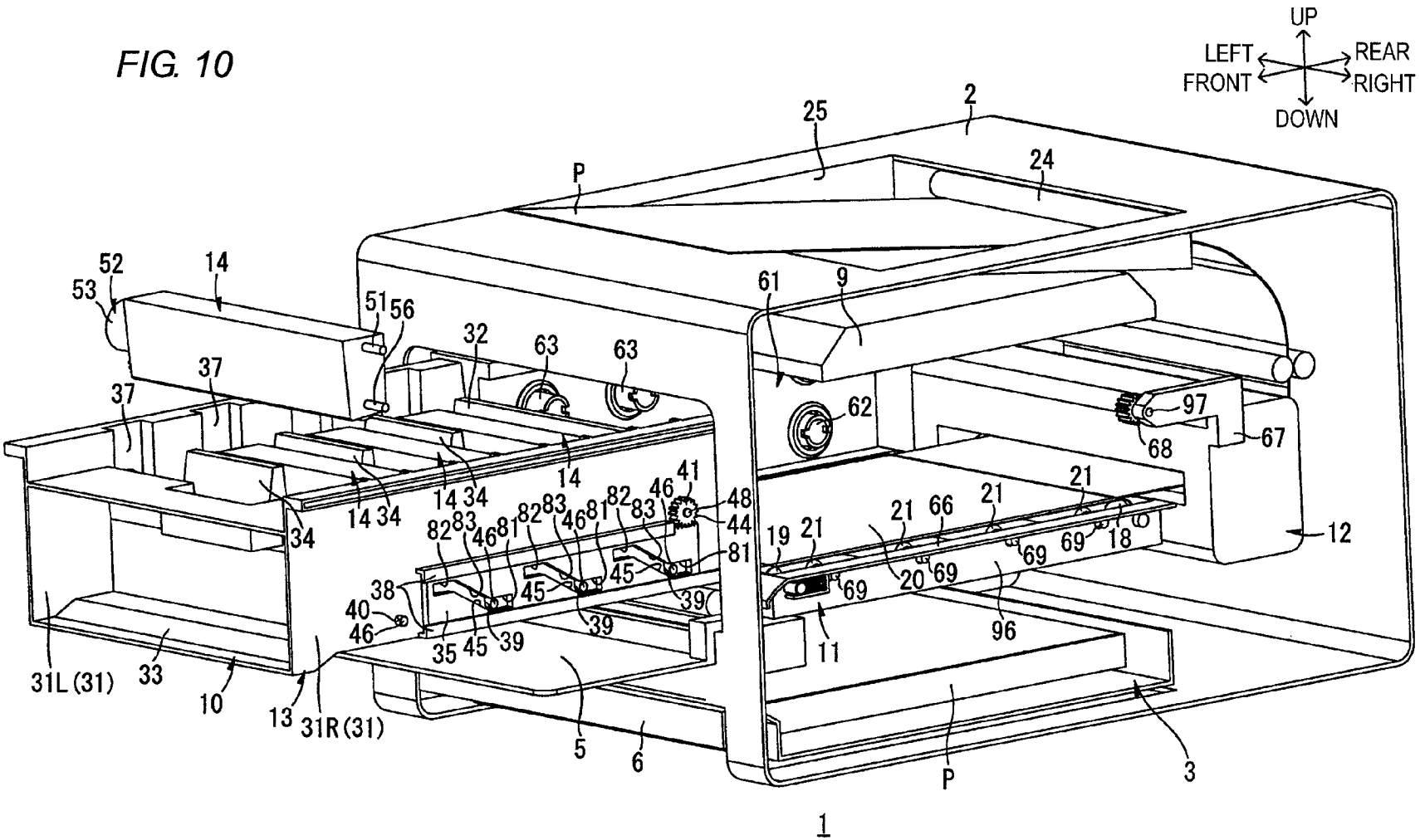
FIG. 10 is a diagram explaining an attachment of the process unit to the main body casing in a state in which the process unit has not been attached.

As shown in FIG. 10, a right end portion of the drum shaft 46 of the black photosensitive drum 15 is inserted into the black drum shaft inserting hole 40, and the drum shafts 46 of the photosensitive drums 15 other than black (i.e., yellow, magenta and cyan photosensitive drums 46) are inserted into the drum shaft guide groove 39.

As shown in FIG. 9, the first drum coupling 47 has a circular disk shape having a diameter smaller than that of the base portion 71 of the drum relay coupling 43 so as to be engaged with the hook portion 74, such that a relative rotation between the first drum coupling 47 and the drum shaft 46 is avoided. The first drum coupling 47 includes a first groove 49 extending in an entire diameter of the first drum coupling 47 so as to accept the drum protrusion 73.

Further, the first drum coupling 47 is engaged with the hook portion 74 in the drum coupling cover 42 in a state in which the drum protrusion 73 is fitted in the first groove 49. Consequently, the first drum coupling 47 is movably, but not relative-rotatably, fitted to the drum relay coupling 43.

As shown in FIGS. 3 and 10, the developer cartridges 14 can contact and can be separated from the photosensitive drums 15. Each of the developer cartridges 14 includes the developing roller 17, a developing guide boss 51 and the developing coupling portion 52.

The developing roller 17 includes a developing roller shaft 56 and a developing roller drive gear 57.

The developing roller shaft 56 passes the developing roller 17 and rotatably fitted to the developer cartridge 14 so as to be coaxially with the developing roller 17.

The developing roller drive gear 57 is provided in a left end portion of the developing roller shaft 56 and outside the developer cartridge 14, such that a relative rotation between the developing roller drive gear 57 and the developing roller shaft 56 is avoided.

The developing guide boss 51 has a cylindrical shape protruding rightward from an upper portion of the left surface of the developer cartridge 14.

The developing coupling portion 52 is provided on a right end portion of the developer cartridge 14 and is configured to transmit a driving force to the developing drive gear 57. The developing coupling portion 52 includes a developing coupling cover 53, a developing relay coupling 54 and a first developing coupling 55.

The developing coupling cover 53 has a cylindrical shape protruding leftward from a left surface of the developer cartridge 14.

As shown in FIGS. 3 and 5, the developing relay coupling 54 is movably fitted in the developing coupling cover 53 and includes a base portion 101, a main body protrusion 102, a developing protrusion 103 and hook portions 104, similar to the drum relay coupling 43 including the base portion 71, the main body protrusion 72, the drum protrusion 73 and the hook portions 74.

The first developing coupling 55 has a circular disk shape and rotatably supported at a left end portion of the developer cartridge 14 by a first developing coupling supporting shaft 58 protruding leftward from the left surface of the developer cartridge 14. The first developing coupling 55 includes: gear teeth 105 provided in a right side circumference edge thereof so as to mesh with the developing roller drive gear 57; and a first groove 106 formed on a left end thereof and extending in an entire diameter thereof so as to be fitted with the developing protrusion 103 of the developing relay coupling 54.

The first developing coupling 55 is engaged with the hook portions 104 in the developing coupling cover 53 in a state in which the developing protrusion 103 is fitted in the first groove 106. Consequently, the first developing coupling 55 is movably, but not relative-rotatably, fitted to the developing relay coupling 54.

Each of the developer cartridges 14 is mounted to the process frame 13 from above such that the developing roller 17 is located in a lower portion thereof. When each of the developer cartridges 14 is mounted to the process frame 13, the developing coupling portion 52 is fitted in the developing coupling fitting hole 37 of the left side plate 31L, and the developing guide boss 51 and the developing roller shaft 56 are fitted in a developing guide groove (not shown) formed in the right side plate 31R. Each of the developer cartridges 14 can be separated from the process frame 13 by removing upward each of the developer cartridges 14.

1.3. Details of Main Body Casing

As shown in FIG. 2, the fixing unit 12 includes a translation cam drive member 67. The translation cam drive member 67 configures a separation mechanism, together with the translation cam 35, the translation cam supporting portion 38, the drum shaft guide groove 39 and the relay gear 41.

The translation cam drive member 67 is integrally formed with the fixing unit 12 on the left upper portion thereof. The translation cam drive member 67 is a flat plate having a substantially L-shape in side view which extends upward and then is bent frontward. The translation cam drive member 67 includes a drive gear supporting shaft 97 and drive gear 68.

The drive gear supporting shaft 97 has a cylindrical shape extending leftward from a front end portion of the translation cam drive member 67.

The drive gear 68 is rotatably supported by the drive gear shaft 97 on a left side of a front end portion of the translation cam drive member 67 so as to mesh with the relay gear 41.

As shown in FIGS. 1 and 3, the transfer unit 11 includes a frame 96, a plurality of, e.g., four, pairs of transfer roller supporting members 64, a plurality of, e.g., four, pairs of compression springs 65 serving as an example of a urging member, and a plurality of, e.g., four, pairs of transfer roller stoppers 66.

The frame 97 has a tray shape extending in the front-rear direction and the right-left direction, and stores the transfer rollers 21.

The transfer roller supporting members 64 of each pair are provided on a left and right sides of the frame 97, so as to correspond to the corresponding transfer roller 21. Each of the transfer roller supporting portions 64 has a substantially rectangular shape in the front cross-sectional view. The transfer roller supporting portions 64 rotatably supports both end portions of the transfer roller shafts 69 of the transfer rollers 21.

As show in FIG. 8, each of the transfer roller supporting portions 64 has: an inserting hole 95 configured to rotatably accept the transfer roller shaft 69; and a compression spring storing portion 94 configured to store the compression spring 65. The inserting hole 95 penetrates an upper portion of the transfer roller supporting portion 64 in the right-left direction. The compression spring storing portion 94 is formed to have a substantially rectangular shape in front cross-sectional view, by cutting the lower portion of the transfer roller supporting portion 64 so as to extend upward from a lower end of the lower portion of the transfer roller supporting portion 64.

An upper end portion of the compression spring 65 is stored in the compression spring storing portion 94, and a lower end portion of the compression spring 65 is connected to the frame 96 of the transfer unit 11. Consequently, the transfer roller supporting portions 64 are always urged upward.

The transfer roller stoppers 66 of each pair are protrusions which protrude from upper ends of right and left sides of the frame 96, respectively, and which extend in the front-rear direction (see FIG. 2). The transfer roller stoppers 66 of each pair contact the corresponding one of the transfer rollers 69 from above. Consequently, an upward movement of each of the transfer rollers 21 is regulated.

The main body casing 2 includes a drive input portion 61.

As shown in FIG. 5, the drive input portion 61 includes a second drum coupling 62 and a second developing coupling 63. The second drum coupling 62 and the second developing coupling 63 are movable along the right-left direction by an advancing-retracting mechanism (not shown).

The second drum coupling 62 includes a gear portion 91 and a fitting portion 92. The gear portion 91 is configured to receive a drive force from a motor (not shown). The fitting portion 92 is provided coaxially with the gear portion 91 and configured to accept the main body protrusion 72 of the drum relay coupling 43.

The gear portion 91 is provided on the left side of the second drum coupling 62 so as to have a circular disc shape having a diameter larger than that of the photosensitive drum 15. Gear teeth are formed on a circumference portion of the gear portion 91.

The fitting portion 92 extends rightward from a right surface of the gear portion 91 and has a cylindrical shape having a diameter substantially the same as a length of the main body protrusion 72. In a right end portion of the fitting portion 92, a second groove 93 configured to accept the main body protrusion 72 is formed in an entire diameter of the fitting portion 92.

The second developing coupling 63 includes a gear portion 107 and a fitting portion 108 having a second groove 109, similar to the second drum coupling 62 including the gear portion 91 and the fitting portion 92 having the second groove 93.

1.4. Attachment of Process Unit to Main Body Casing

Figure 11:
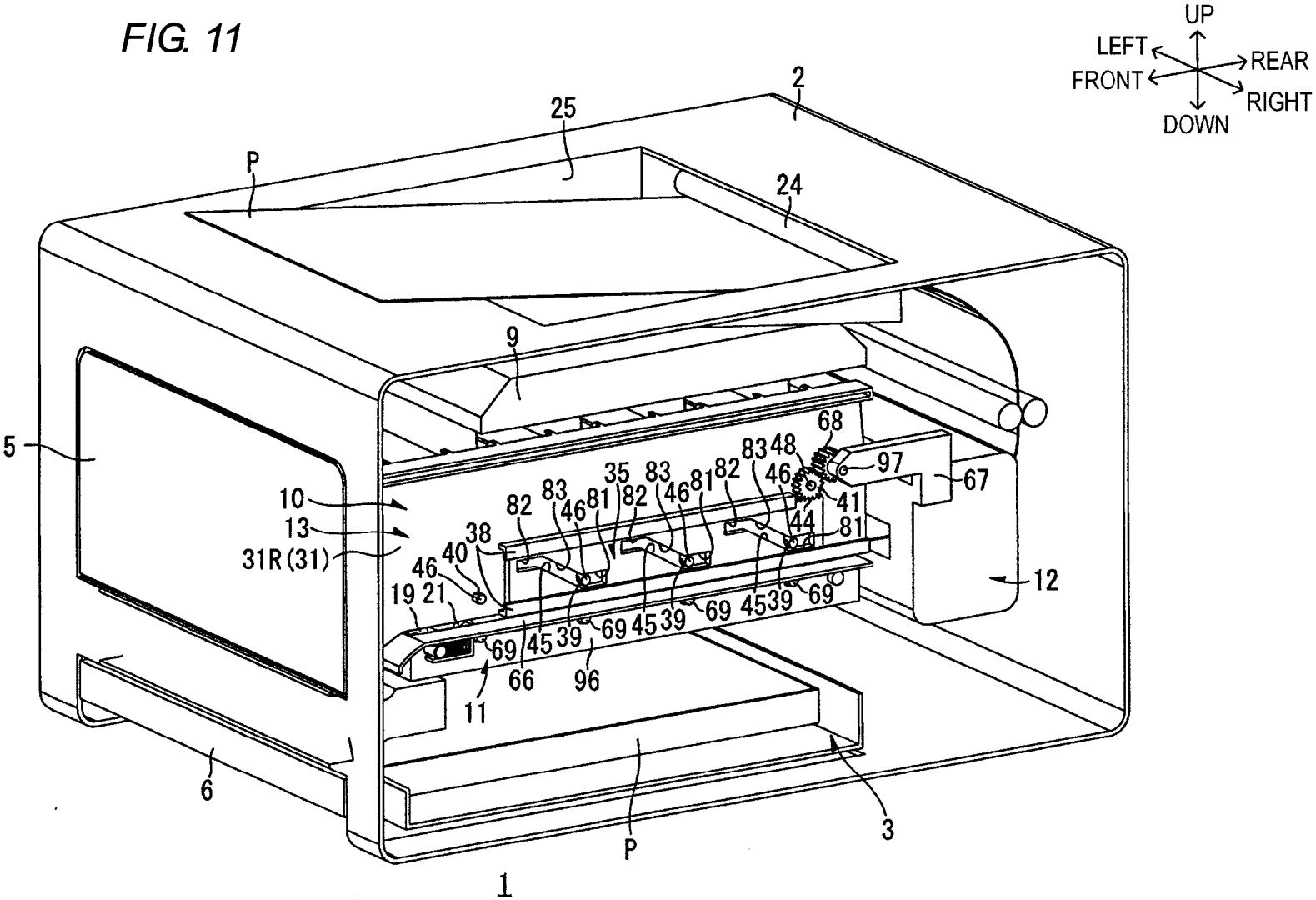
FIG. 11 is a diagram explaining the attachment of the process unit to the main body casing in a state in which the process unit has been attached.

As shown in FIG. 10, when the process unit 10 is attached to the main body casing 2, the rear end portion of the process unit 10 is inserted into the main body casing 2, and then the process unit 10 is pushed rearward with respect to the main body casing 2. Consequently, as shown in FIG. 11, the relay gear 41 meshes with the drive gear 68.

By the advancing-retracting mechanism (not shown), the second drum couplings 62 advance toward the respective drum relay couplings 43, and when the main body protrusions 72 are fitted in the second grooves 93, the drum shafts 46 and the second drum couplings 62 are connected so as not to be relatively rotatable.

Similarly, the second developing couplings 63 advance toward the respective developing relay couplings 55, and when the main body protrusions 102 are fitted in the second groove 109, the developing roller shafts 56 and the second developing couplings 63 are connected so as not to be relatively rotatable.

Accordingly, the attachment of the process unit 10 to the main body casing 2 is completed.

Thereafter, when the drive force is input from the motor (not shown) to the second drum couplings 62 of the drive input units 61, the drive force is transmitted to the first drum couplings 47 via the respective drum relay couplings 43, whereby the photosensitive drums 15 are driven.

When the drive force is input to the second developing couplings 63, the drive force is transmitted to the first developing couplings 55 via the respective developing relay coupling 54, whereby the developing rollers 17 are driven.

1.5. Operation of Process Unit

After the process unit 10 is attached to the main body casing 2, as show in FIG. 11, the translation cam 35 is disposed at a first position such that the front end portion of the rack portion 44 meshes with the relay gear 41. Further, the drum shafts 46 of the yellow, magenta and cyan photosensitive drums 15 are fitted in the rear portions 81 of the respective cam grooves 45.

At this time, as shown in FIG. 3, an enter width (in the right-left direction) of the photosensitive drums 15 contacts the conveyor belt 20 from above. The transfer rollers 21 are pressed by the respective photosensitive drums 15 from above and are positioned at contact positions against the urging force of the respective compression springs 65.

That is, the color laser printer 1 is in a color mode in which a color image is formed.

In the color mode, when the driving force is input to the second drum couplings 62 and the second developing couplings 63, the driving force is transmitted to all the photosensitive drums 15 and all the developer cartridges 14, whereby the color image is formed.

When a rearward drive force is transmitted from the drive gear 68 to the translation cam 35 via the relay gear 41 and the rack portion 44, the translation cam 35 is slid rearward.

Figure 12:
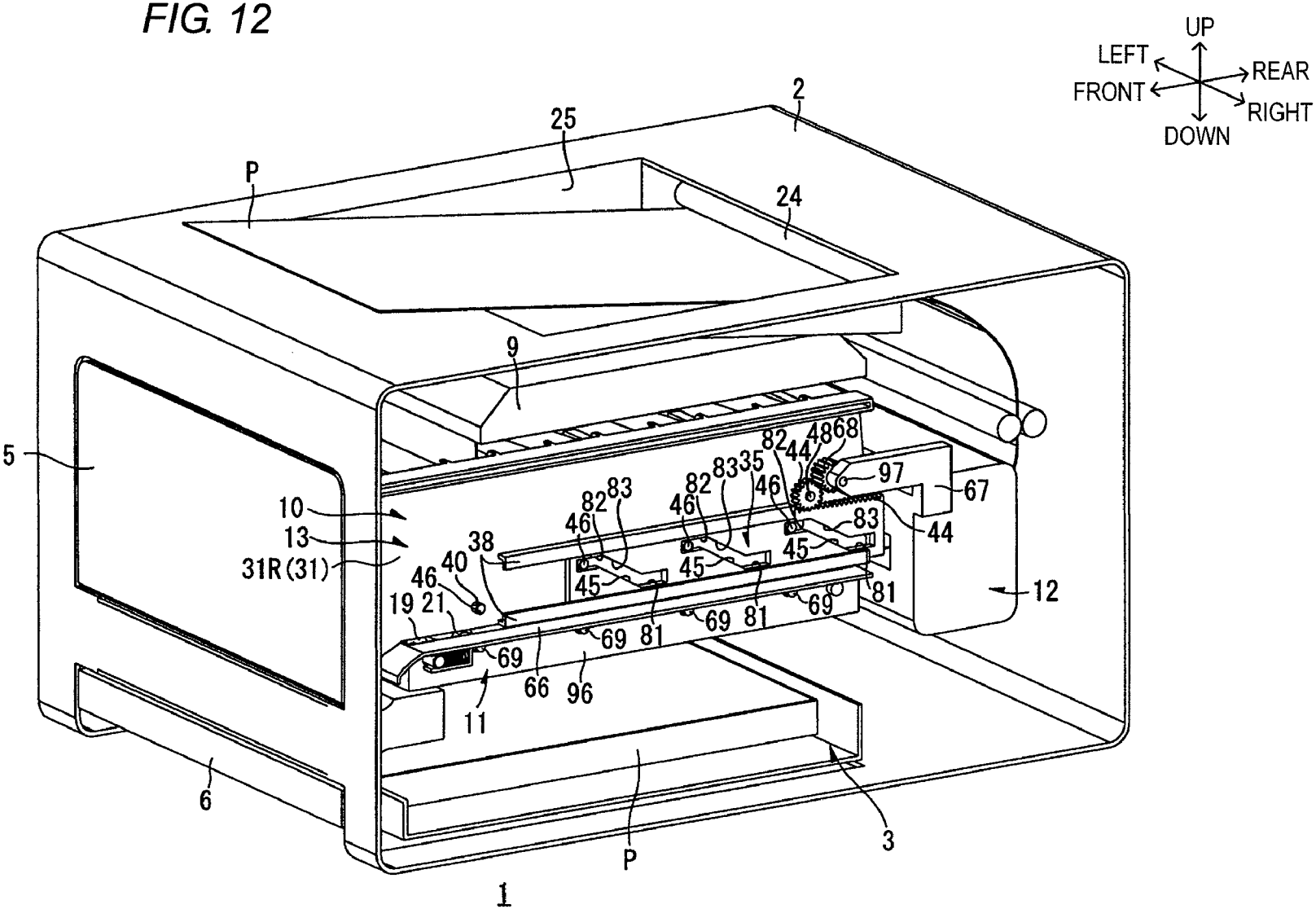
FIG. 12 is a diagram explaining an operation of the process unit in the main body casing.

Consequently, the right end portions of the drum shafts 46 of the yellow, magenta and cyan photosensitive drums 15 are pressed upward along the inclined portions 83 of the respective cam grooves 45, and moves upward by the respective drum shaft guide grooves 39. Then, as shown in FIG. 12, the drum shafts 46 are fitted to the front end portions 82 of the respective cam grooves 45. Accordingly, the translation cam 35 is disposed at a second position.

Figure 4:
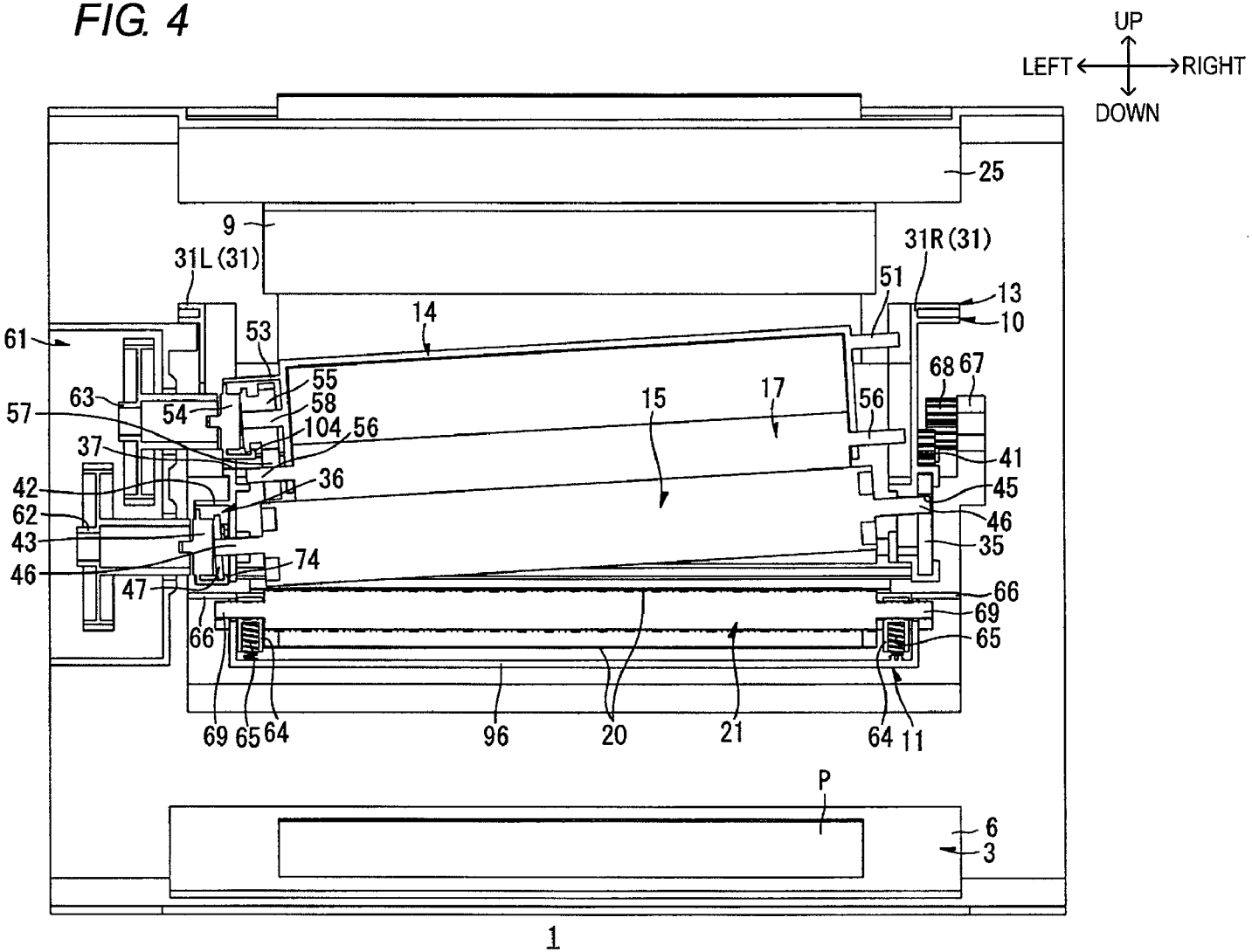
FIG. 4 is a cross-sectional view, corresponding to FIG. 3, in which photosensitive drums is separated from a conveying belt.

At this time, as shown in FIG. 4, the yellow, magenta and cyan photosensitive drums 15 are swung in an anticlockwise direction in front view around a left end portions of the photosensitive drums 15 supported by the left side frame 31L as pivot fulcra, while connections between the first drum couplings 47 and the respective drum relay couplings 43 and connections between the drum relay couplings 43 and the respective second drum couplings 62 are maintained (also see FIG. 8).

Specifically, as shown in FIG. 5, when the drum protrusion 73 is arranged along the up-down direction, each of the yellow, magenta and cyan photosensitive drums 15 can be swung such that the lower portion of the first drum coupling 47 is slightly separated from the drum relay coupling 43 while the connection between the upper portion of the first drum coupling 47 and the drum relay coupling 43 is maintained.

Figure 6:
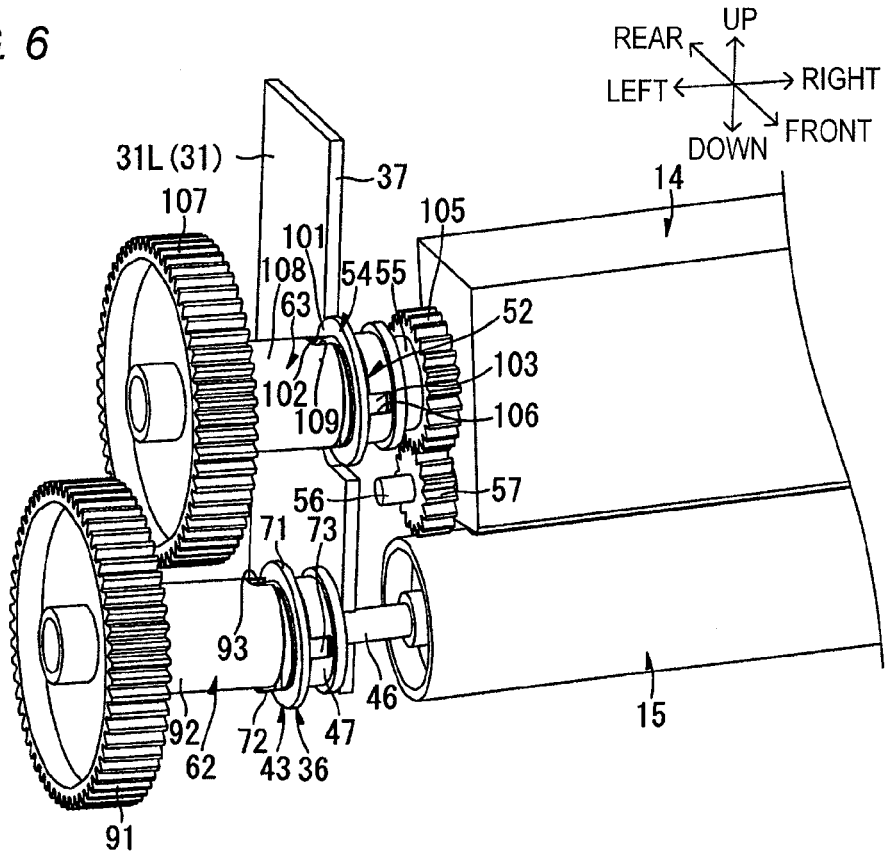
FIG. 6 is a diagram explaining a swing movement of the photosensitive drum shown in FIG. 4 and showing a state in which a main body protrusion extends along an up-down direction.

Further, as shown in FIG. 6, when the main body protrusion 72 is arranged along the up-down direction, each of the yellow, magenta and cyan photosensitive drums 15 can be swung such that the lower portion of the drum relay coupling 43 is slightly separated from the second drum coupling 62 while the connection between the upper portion of the drum relay coupling 43 and the second drum coupling 62 is maintained.

Figure 7:
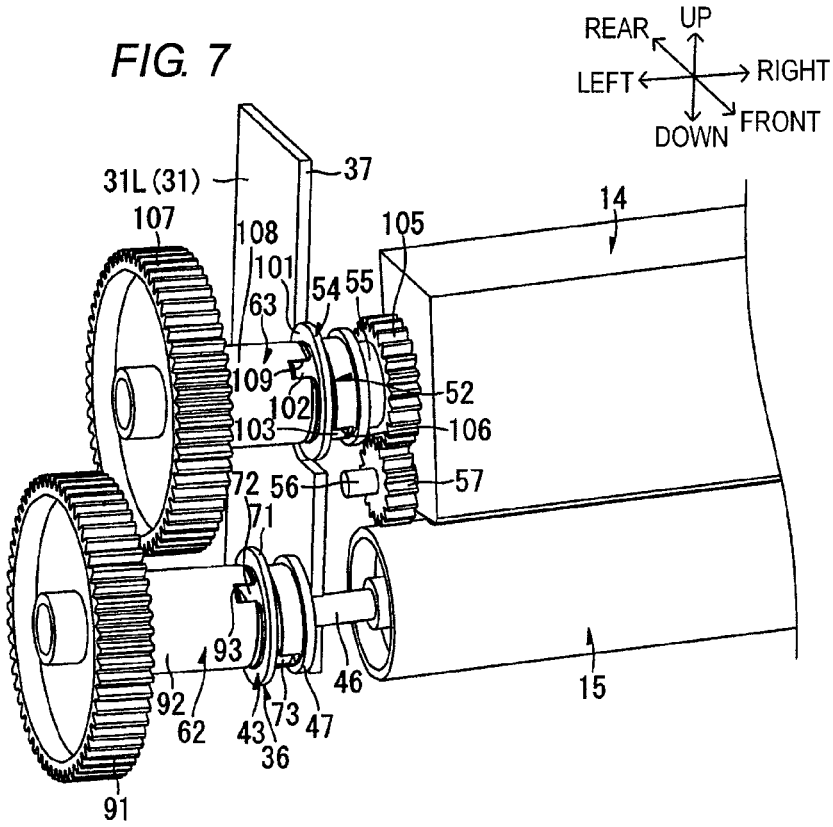
FIG. 7 is a diagram explaining a swing movement of the photosensitive drum shown in FIG. 4 and showing a state in which neither the drum protrusion nor the main body protrusion extends along an up-down direction.

Further, as shown in FIG. 7, when neither the main body protrusion 72 nor the drum protrusion 73 is arranged along the up-down direction, each of the yellow, magenta and cyan photosensitive drums 15 can be swung such that the lower portions of the first drum coupling 47 and the drum relay coupling 43 are slightly separated from the drum relay coupling 43 and the second drum coupling 62, respectively, while the connection between the upper portion of the first drum couplings 47 and the drum relay coupling 43 and the connection between the upper portion of the drum relay coupling 43 and the second drum coupling 62 are maintained.

That is, the connection between the drum relay coupling 43 and at least one of the first drum coupling 47 and the second drum coupling 62 is adjusted so as to be adapted to the swing movement of the photosensitive drum 15. Therefore, each of the yellow, magenta and cyan photosensitive drums 15 can be swung without releasing a drive transmission.

At this time, as shown in FIG. 4, each of the yellow, magenta and cyan developer cartridges 14 is swung in the anticlockwise direction in front view while the connection between the first developing coupling 55 and the developing relay coupling 54 and the connection between the developing relay coupling 54 and the second developing coupling 63 (see also FIG. 8).

Specifically, as shown in FIG. 5, when the developing protrusion 103 is arranged along the up-down direction, each of the yellow, magenta and cyan developer cartridges 14 can be swung such that the lower portion of the first developing coupling 55 is slightly separated from the developing relay coupling 54 while the connection between the upper portion of the first developing coupling 55 and the developing relay coupling 54 is maintained.

Further, as shown in FIG. 6, when the main body protrusion 102 is arranged along the up-down direction, each of the yellow, magenta and cyan developer cartridges 14 can be swung such that the lower portion of the developing relay coupling 54 is slightly separated from the second developing coupling 63 while the connection between the upper portion of the developing relay coupling 54 and the second developing coupling 63 is maintained.

Further, as shown in FIG. 7, when neither the main body protrusion 102 nor the developing protrusion 103 is arranged along the up-down direction, each of the yellow, magenta and cyan developer cartridges 14 can be swung such that the lower portions of the first developing coupling 55 and the developing relay coupling 54 are slightly separated from the developing relay coupling 54 and the second developing coupling 63, respectively, while the connection between the upper portion of the first developing coupling 55 and the developing relay coupling 54 and the connection between the developing relay coupling 54 and the second developing coupling 63 are maintained.

That is, similar to the photosensitive drums 15, the connection between the developing relay coupling 54 and at least one of the first developing coupling 55 and the second developing coupling 63 is adjusted so as to be adapted to the swing movement of the developer cartridge 14. Therefore, each of the yellow, magenta and cyan developer cartridges 14 can be swung together with the photosensitive drums 15 without releasing a drive transmission.

Further, when each of the yellow, magenta and cyan photosensitive drums 15 are swung, as shown in FIG. 4, the entire width (in the right-left direction) of the photosensitive drum 15 is separated from the conveyor belt 20. Each of the transfer rollers 21 corresponding yellow, magenta and cyan is positioned at a separated position at which the transfer roller shaft 69 contacts the transfer roller stopper 66 and which is higher than (i.e., an upper side of) the contact position (indicted by an imaginary line in FIG. 4) by the urging force of the compression spring 65.

At this time, the yellow, magenta and cyan photosensitive drums 15 are swung so as to be arranged above the separated positions of the transfer rollers 21 corresponding yellow, magenta and cyan.

Accordingly, while the entire width of the black photosensitive drum 15 contacts the conveyor belt 20, the entire widths of the yellow, magenta and cyan photosensitive drums 15 are separated from the conveyor belt 20. Therefore, the color laser printer 1 is in a monochrome mode in which a monochrome image is formed.

In the monochrome mode, in a state in which the photosensitive drums 15 other than black (i.e., the yellow, magenta and cyan photosensitive drums 15) are separated from the conveyor belt 20, when the drive force is input to the second drum coupling 62 corresponding to black and the second developing coupling 63 corresponding to black, the black image can be formed.

1.6. Effects and Advantages (1) The color laser printer 1 includes the separation mechanism, as shown in FIG. 4, configured to press the drum shaft 46 of at least one (e.g., yellow, magenta and cyan photosensitive drums) of the plurality of photosensitive drums 15 (e.g., black, yellow magenta and cyan photosensitive drums) along the respective cam grooves 45 by the translation cam 35, and to separate the entire widths of the yellow, magenta and cyan photosensitive drums 15 from the conveyor belt 20.

Consequently, when the separation mechanism presses the drum shaft 46 at the right end portion of the photosensitive drum 15, the entire width of the photosensitive drum 15 can be separated from the conveyor belt 20.

As a result, as compared with the mechanism for separating both ends of the photosensitive drum 15 from the conveyor belt 20, the photosensitive drum 15 can be separated from the conveyor belt 20 by a simplified configuration.

(2) According to the color laser printer 1, as shown in FIG. 4, the separation mechanism is configured to press the drum shaft 46 at the right end portion of the photosensitive drum 15, and to swing the photosensitive drum 15 about the drum shaft 46 at the left end portion of the photosensitive drum 15 as a fulcrum, thereby separating the photosensitive drum 15 from the conveyor belt 20.

Consequently, the photosensitive drum 15 can be separated from the conveyor belt 20 without a large positional variation of the drum shaft 46 at the left portions of photosensitive drums 15.

As a result, by inputting the drive force from the left end portion of the photosensitive drum 15 by the drum coupling portion 36, the photosensitive drum 15 can be swung and separated from the conveyor belt 20 without releasing the drive input.

(3) According to the color laser printer 1, as shown in FIGS. 3 and 4, the transfer roller 21 is positioned at the contact position when the corresponding photosensitive drum 15 contacts the conveyor roller 20, and is positioned at the separated position when the corresponding photosensitive drum 15 is separated from the conveyor belt 20. The separated position is higher than (i.e., an upper side of) the contact position. On the other hand, the photosensitive drum 215 is pressed upward so as to be disposed above the separated position.

Therefore, when the photosensitive drum 15 is pressed upward, the photosensitive drum 15 is disposed above the separated position of the transfer roller 21 and separated from the conveyor belt 20.

As a result, the transfer roller 21 at the contact position can securely presses the photosensitive drum 15 via the conveyor belt 20, and the transfer roller 21 at the separated position can surely separate the photosensitive drum 15 from the conveyor belt 20.

(4) According to the color laser printer 1, as shown in FIGS. 3 and 4, at the drum shaft 46 at the left end portion of the photosensitive drum 15, the drum coupling portion 36 configured to transmit the drive force is formed to the photosensitive drum 15.

Therefore, the drive force can be transmitted to the photosensitive drum 15 at the drum shaft 46 at the left end portion of the photosensitive drum 15 which is a pivot fulcrum thereby being less likely to change its position even when the photosensitive drum 15 is swung.

Further, by the drum coupling portion 36, the drive force can be input to the left end portion of the photosensitive drum 15 from the left direction.

Accordingly, even when the photosensitive drum 15 is swung, the drive input from the left direction is not released. Consequently, the photosensitive drum 15 can be separated from the conveyor belt 20 without the release of the drive transmission to the photosensitive drum 15 at the left end portion of the photosensitive drum 15.

As a result, it is not necessary to provide a mechanism for releasing the drive transmission to the photosensitive drum 15, and the entire width of the photosensitive drum 15 can be separated from the conveyor belt 20 by a simplified configuration.

(5) According to the color laser printer 1, as shown in FIGS. 11 and 12, the translation cam 35 configured to press the photosensitive drum 15 is movable to take the first position and the second position. The translation cam 35 at the first position allows all the photosensitive drum 15 to contact the conveyor belt 20. The translation cam 35 at the second position allows the photosensitive drum 15 configured to form a black image to contact the conveyor belt 20 and also allows the rest of photosensitive drums 15 to be swung.

Therefore, the translation cam 35 can switch the mode of the color laser printer 1 between the color mode and the monochrome mode. Specifically, the translation cam 35 at the first position allows the color laser printer 1 to operate in the color mode in which the color image is formed by bringing all the photosensitive drums 15 into contact with the conveyor belt 20. Further, the translation cam 35 at the second position allows the color laser printer 1 to operate in the monochrome mode in which the monochrome image is formed by bringing only the photosensitive drum 15 configured to form the black image into contact with the conveyer belt 20.

As a result, the mode can be switched by a simplified operation, i.e., sliding the translation cam 35.

(6) According to the color laser printer 1, as shown in FIGS. 11 and 12, the swing movement of the photosensitive drum 15 can be guided by the cam groove 45 formed in the translation cam 35.

Therefore, the photosensitive drum 15 can surely be swung by sliding the translation cam 35.

(7) According to the laser color printer 1, as shown in FIG. 3, the drum shaft 46 at the left end portion of the photosensitive drum 15 is disposed outside the conveyer belt 20.

Therefore, when the photosensitive drum 15 is swung about the drum shaft 46 at the left end portion of the photosensitive drum 15 as the pivot fulcrum, a portion of the photosensitive drum 15, which is closer to the right end than the drum shaft 46 at the left end portion of the photosensitive drum 15, can be separated from the conveyer drum 20.

As a result, the entire width of the photosensitive drum 15 can surely be separated from the conveyer drum 20.

(8) According to the color laser printer 1, as shown in FIGS. 3 and 4, the developing roller 17 is disposed adjacent to the corresponding photosensitive drum 15 in the up-down direction, and is swung together with the corresponding photosensitive drum 15. Further, the developing coupling portion 52 configured to transmit the drive force to the developing roller 17 is formed at the left end portion of the developing roller 17.

Consequently, the drive force can be input to the left end portion of the developing roller 17 along the right-left direction by the developing coupling portion 52.

Accordingly, even when the developing roller 17 is swung together with the photosensitive drum 15, it is not necessary to provide a mechanism for releasing the drive transmission to the developing roller 17. As a result, the developing roller 17 can be swung together with the corresponding photosensitive drum 15 by the simplified configuration.

(9) According to the laser printer 1, as shown in FIG. 10, the developer cartridge 14 storing the developing roller 17 and capable of contacting and being separated from the photosensitive drum 15 is provided.

Consequently, the developer cartridge 14 can be exchanged by detaching only the corresponding developer cartridge 14 to be exchanged. Therefore, the maintenance of the developer cartridge 14 can be performed effectively.

(10) According to the color laser printer 1, as shown in FIG. 10, the process unit 10 supporting the photosensitive drums 15 is provided.

Therefore, the photosensitive drums 15 can integrally be operated.

(11) According to the color laser printer 1, as shown in FIG. 2, the process unit 10 includes the right side plate 31R having the drum shaft guide groove 39 configured to guide the swing movement of the photosensitive drum 15 along the up-down direction.

Consequently, when the photosensitive drum 15 is swung by sliding the translation cam 35, it is possible to prevent the photosensitive drum 15 from departing in the front-rear direction in which the translation cam 35 is slid.

As a result, the photosensitive drum 15 is swung along the drum shaft guide groove 39, and can reliably contact and be separated from the conveyer belt 20.

(12) According to the color laser printer 1, as shown in FIG. 8, the photosensitive drum 15 can be swung around a portion supported by the left side plate 31L as a fulcrum.

Consequently, by using the left side plate 31L, the right end portion of the photosensitive drum 15 can be swung.

As a result, the photosensitive drum 15 can be separated from the conveyor belt 20 by more simplified configuration.

2. Second Exemplary Embodiment

2.1. Overview of Color Laser Printer

Figure 13:
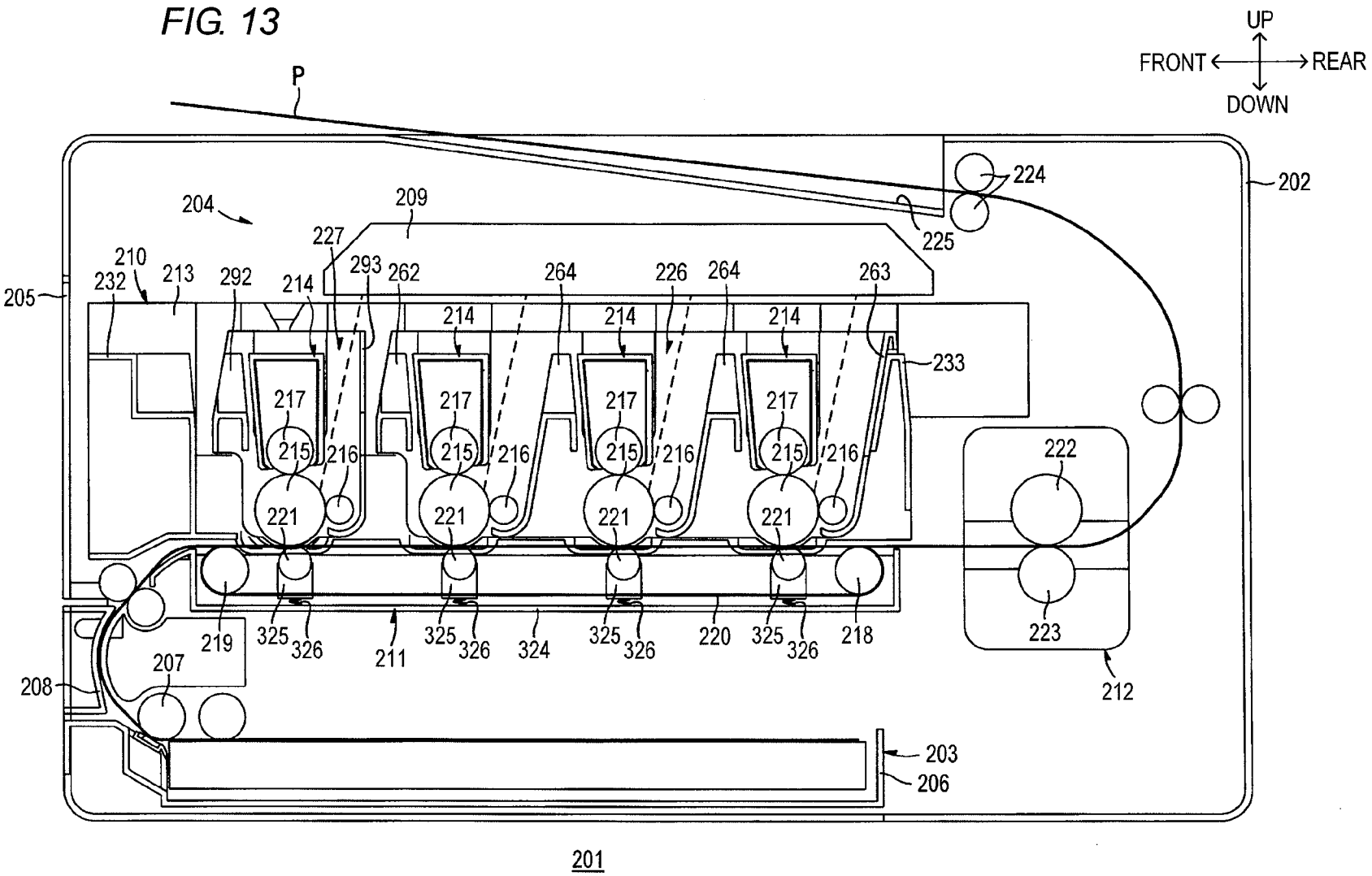
FIG. 13 is a side cross-sectional view showing a color laser printer as an example of an image forming apparatus according to a second exemplary embodiment of the invention.

As shown in FIG. 13, a color printer 201 of a second exemplary embodiment is a transverse-mounted tandem color laser printer. The color printer 201 includes a main body casing 202. The color printer 201 further includes, in the main body casing 202, a sheet feeding unit 203 configured to feed a sheet and an image forming unit 204 configured to form an image on the sheet P fed by the sheet feeding unit 203.

(1) Main Body Casing

The main body casing 202 has a substantially box shape which is substantially rectangular in side view and which stores the image forming unit 204. A front side wall of the main body casing 202 includes a front cover 205 movable between an open position and a close position. When the front cover 205 is in the open position, a process unit 210 can be attached to and detached from the color printer 1.

(2) Sheet Feeding Unit

The sheet feeding unit 203 includes a sheet feeding tray 206 configured to store sheets P. The sheet feeding tray 206 is removably attached to a bottom area in the main body casing 202. Above a front end of the sheet feeding tray 206, a sheet feeding roller 207 and a sheet feeding path 208 are disposed. The sheet feeding path 208 includes a U-turn path.

The sheets P stored in the sheet feeding tray 206 are fed one at a time toward the sheet feeding path 208 by rotation of the sheet feeding roller 207. Subsequently, the sheet P is conveyed from the sheet feeding path 208 toward the image forming unit 204 (specifically, between photosensitive drums 215 and a conveying belt 220). The number of photosensitive drums 215 is, for example, four.

(3) Image Forming Unit

The image forming unit 204 includes a scanner unit 209, a process unit 210 as an example of a drawer member, a transfer unit 211, and a fixing unit 212.

(3-1) Scanner Unit

The scanner unit 209 is disposed in an upper portion of the main body casing 202. As indicated by a broken line in FIG. 1, the scanner unit 209 emits laser beams based on image data toward the four photosensitive drums 215, thereby exposing the photosensitive drums 215.

(3-2) Process Unit (3-2-1) Configuration of Process Unit

The process unit 210 is disposed at a position below the scanner unit 209 and above the sheet feeding unit 203. The process unit 210 includes: a process frame 213 serving as an example of one drawer member, a color unit 226 serving as an example of one first holding member; a black unit 227 serving as an example of one second holding member; and a plurality of, e.g., four, developer cartridges 214 corresponding to respective colors.

The process frame 213 is slidable along a front-rear direction relative to the main body casing 202 (i.e., the process frame 213 can be pulled frontward), and holds the color unit 226 and the black unit 227.

The color unit 226 and the black unit 227 are detachably attachable to a process frame 213 and hold a plurality of, e.g., four photosensitive drums 215 corresponding to respective colors which serve as an example of photosensitive members and a plurality of, e.g., four charging rollers 216 corresponding to the respective photosensitive drums 215. Specifically, the color unit 226 integrally holds three photosensitive drums 215 corresponding to yellow, magenta and cyan and three charging roller 216 corresponding thereto, and the black unit 227 integrally holds a photosensitive drum 215 corresponding to black and a charging roller 216 corresponding thereto.

The (four) photosensitive drums 215 are arranged along the right-left direction and spaced from each other in the front-rear direction, so as to correspond to respective colors, i.e., black, yellow, magenta and cyan from the front side toward the rear side. As used herein, the photosensitive drums 215 of respective colors are also referred to as a black photosensitive drum 215, a yellow photosensitive drum 215, a magenta photosensitive drum 215 and a cyan photosensitive drum 215.

The charging rollers 216 are disposed adjacent to the respective photosensitive drums 215 on the rear sides of the photosensitive drums 215.

The developer cartridges 214 are disposed adjacent to and on the upper sides of the respective photosensitive drums 215. Each of the developer cartridges 214 includes a developing roller 217.

The developing roller 217 is rotatably supported to the developer cartridge 214 so as to expose from a lower end of the developer cartridge 214, and is disposed adjacent to the photosensitive drum 215 so as to contact the photosensitive drum 215 from the upper side thereof.

Although not shown, each of the developer cartridges 214 includes a supply roller configured to supply toner to the developing roller 217, and a layer thickness regulating blade configured to regulate a thickness of the toner supplied to the developing roller 217. Further, each of the developer cartridges 214 accommodates toner of a corresponding color in a space above the supply roller and the layer thickness regulating blade.

(3-2-2) Developing Operation of Process Unit

Toner accommodated in the developer cartridge 214 is supplied to the supply roller (not shown) and further to the developing roller 217, and then positively charged through friction between the supply roller (not shown) and the developing roller 217.

The thickness of the toner supplied to the developing roller 217 is regulated by a layer thickness regulating blade (not shown) in association with rotation of the developing roller 217, and the toner is carried on the surface of the developing roller 217 as a thin layer of given thickness.

Surfaces of the photosensitive drums 215 are uniformly positively charged by the respective charging rollers 216 along with rotation of the respective photosensitive drums 215. Subsequently, the surfaces of the photosensitive drums 215 are exposed to laser beams (see broken lines in FIG. 13) originating from the scanner unit 209 through high speed scan. An electrostatic latent image corresponding to an image to be formed on the sheet P is thereby formed on the surfaces of the respective photosensitive drums 215.

When the photosensitive drums 215 further rotate, the positively-charged toner held on the surfaces of the developing rollers 217 is supplied to the electrostatic latent images formed on the respective surfaces of the photosensitive drums 215. The electrostatic latent images of the photosensitive drums 215 are thereby made visible, whereupon toner images formed by reversal development are held on the surfaces of the photosensitive drums 215 corresponding to the respective colors.

(3-3) Transfer Unit

The transfer unit 211 is disposed along the front-rear direction within the main unit casing 202 at a position above the sheet feeding unit 203 and at a position below the process unit 210. The transfer unit 211 includes: a drive roller 218; a driven roller 219; a conveyor belt 220 serving as an example of an endless belt which contacts the photosensitive drums 215; and transfer rollers 221 serving as an example of transfer members.

The drive roller 218 and the driven roller 219 are arranged to oppose and to be spaced from each other in the front-rear direction. The conveyor belt 220 includes an endless belt that passes around the drive roller 218 and the driven roller 219.

The four transfer rollers 221 are arranged in parallel and spaced from one another so as to oppose the respective photosensitive drums 215 with the conveyor belt 220 sandwiched therebetween.

The sheet P fed from the sheet feeding unit 203 is conveyed from the front side to the rear side by means of the conveyor belt 220 so as to sequentially pass through the space between each of the photosensitive drums 215 and a corresponding one of the transfer rollers 221. During conveyance of the sheet P, the toner images of respective colors held on the respective photosensitive drums 215 are sequentially transferred, thereby a color image is produced on the sheet P.

(3-4) Fixing Unit

A fixing unit 212 is arranged on the rear side of the transfer unit 211 and includes a heating roller 222 and a press roller 223 opposing the heating roller 222. In the transfer unit 211, the color image transferred to the sheet P is thermally fixed on the sheet P by heating and pressurization while the sheet P passes through the heating roller 222 and the press roller 223.

(4) Sheet Output

The sheet P having the toner image fixed thereon is conveyed through a U-turn sheet output path (not shown) toward sheet output rollers 224 and output on a sheet output tray 225 formed in an upper surface of the main unit casing 202 by means of the sheet output rollers 224.

2.2. Details of Process Unit (1) Process Frame

Figure 14:
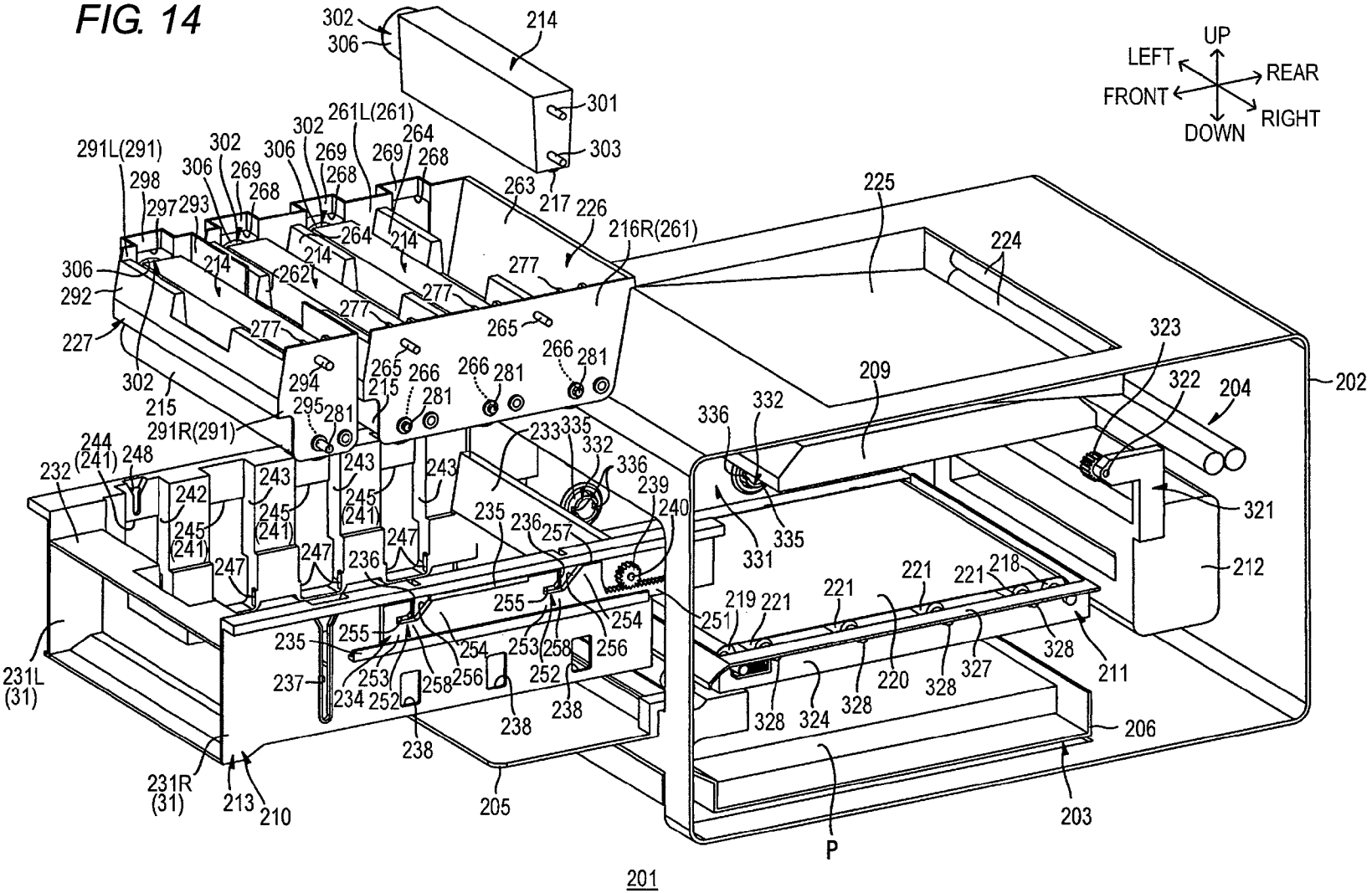
FIG. 14 is a perspective view of the color laser printer shown in FIG. 13 viewed from a right front side of the color printer, in a state in which a process unit is pulled out and a color unit and a black unit are separated from the process unit.

As shown in FIG. 14, the process frame 213 includes: a pair of process side plates 231 laterally spaced from and opposing each other; a process front beam 232, a process rear beam 233 and a translation cam 234 serving as an example of a reciprocating member.

Figure 20:
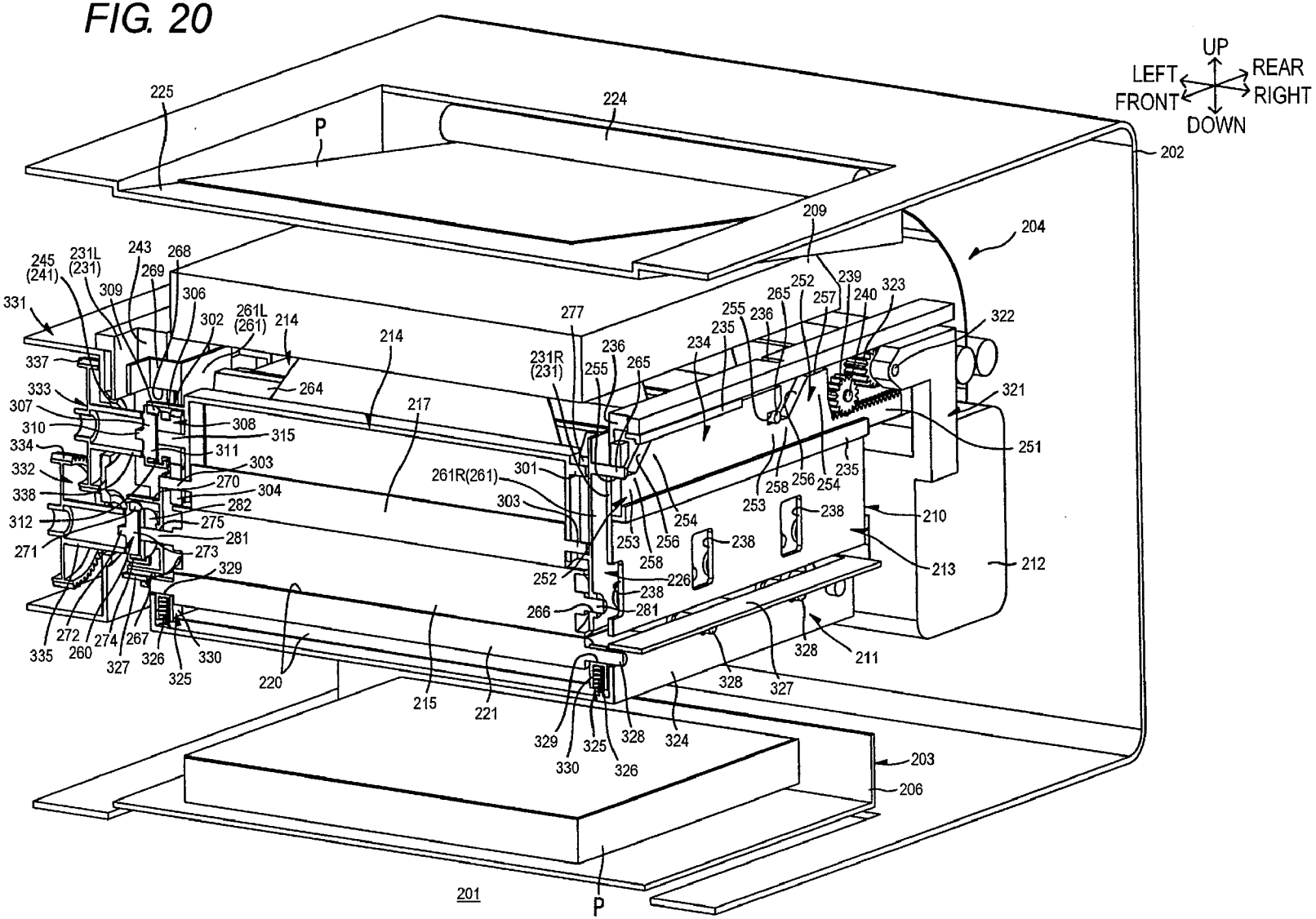
FIG. 20 is a perspective cross-sectional view of the color laser printer shown in FIG. 13 viewed from the right front side of the color printer, in a state in which the process unit is stored in the main body casing.

Each of the process side plates 231 has a substantially rectangular shape in side view and is disposed outside the conveyor belt 220 (see FIG. 20). As used herein, when the right side and left side are identified for the process side frames 231, one of the process side plates 231 which is located on the right side is referred to as a right process side plate 231R, and the other of the process side plates 231 which is located on the left side is referred to as a left process side plate 231L.

Figure 15:
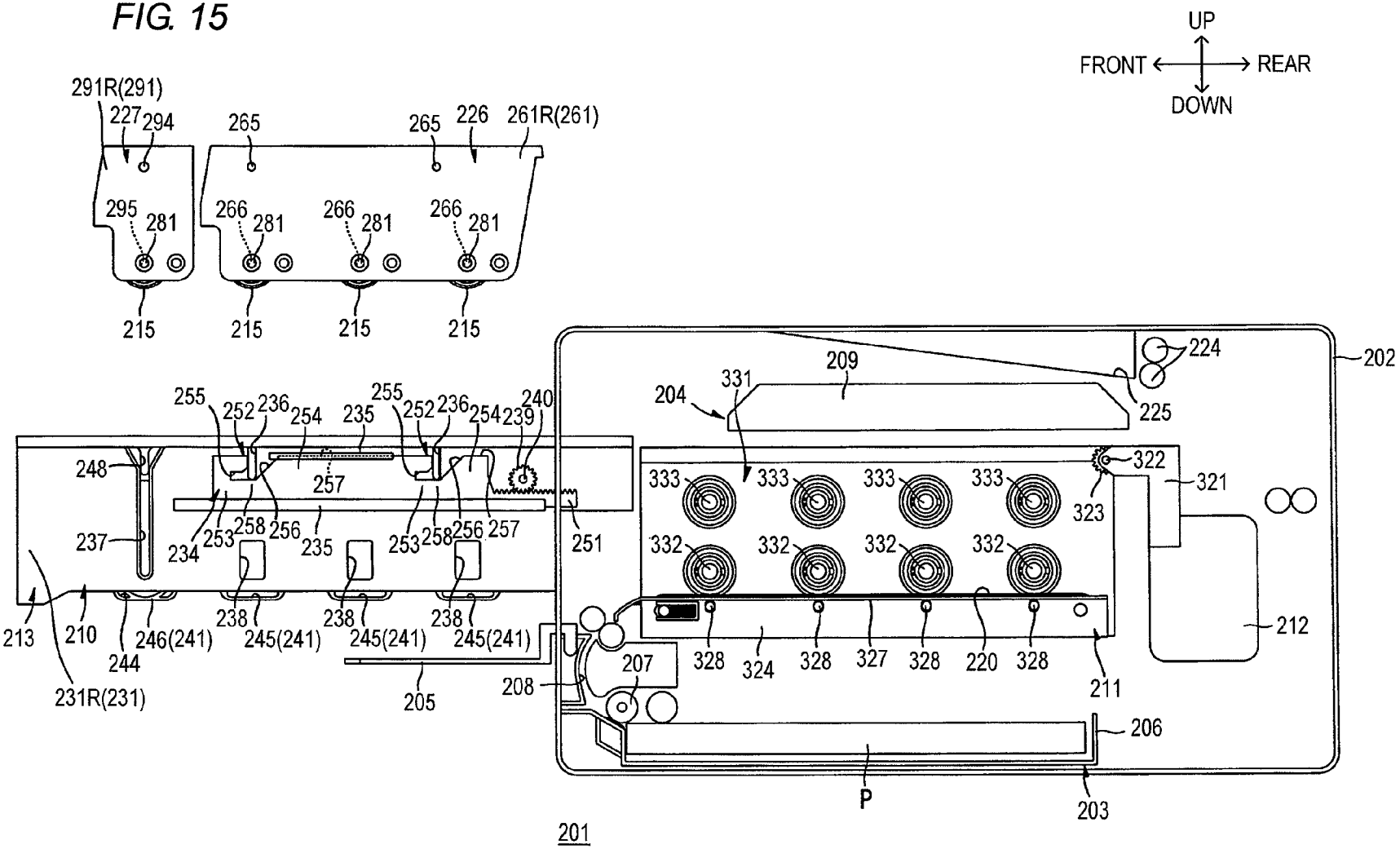
FIG. 15 is a left side view of the color laser printer shown in FIG. 14.

As shown in FIG. 15, the right process side plate 231R includes: a right black guide groove 237; three drum shaft exposing opening 238; front and rear right color guide grooves 236 serving as an example of a second guide portion; and upper and lower translation cam supporting portions 235. Further, the right process side plate 231R includes a relay gear 239

The right black guide groove 237 is a cut formed in a front end portion of the right process side plate 231R so as to extend downward from an upper end of the right process side plate 231R, and has a substantially Y-shape opened upward in side view. The right black guide groove 237 is formed almost entire portion of the right process side plate 231R in the up-down direction. A lower end portion of the right black guide groove 237 is disposed in a lower end portion of the right process side plate 231R. The right black guide groove 37 guides an attachment of the black unit 227 to the process frame 213, and the lower end portion of the right black guide groove 237 accepts a drum shaft 281 of the black photosensitive drum 215.

Each of the drum exposing openings 238 has a rectangular shape having longer sides extending in the up-down direction. The drum exposing opening 238 are formed in the lower end portion of the right process side plate 231R, and arranged in parallel and are spaced with substantially same intervals in the front-rear direction between the right black guide groove 237 and a rear end portion of the right process side plate 231R. When the color unit 226 is attached to the process frame 213, the drum shafts 281 of the yellow, magenta and cyan photosensitive drums 215 are exposed from the respective drum shaft exposing openings 238 toward right side.

Each of the right color guide groove 236 is a cut formed in the right process side plate 231R at a portion closer to the rear end thereof than the right black guide groove 237 so as to extend downward from the upper end portion of the right process side plate 231R along the up-down direction thereby having a substantially U-shape opened upward in side view. A lower end portion of each of the right color guide grooves 236 is arranged above a substantially center of the right process side plate 231R in the up-down direction. The front right color guide groove 236 is arranged on an upper side of the frontmost drum shaft exposing opening 238, and a rear right color guide groove 236 is arranged on a front upper side of the rearmost drum shaft exposing opening 238.

Each of the translation cam supporting portions 235 is a protrusion extending in the front-rear direction on the right process side plate 231R and has a substantially L-shape in cross section. The translation cam supporting portions 235 are arranged so as to oppose and spaced from each other in the up-down direction.

The upper translation cam supporting portion 235 protrudes rightward from the right surface of the right process side plate 231R and is bent downward. Further, the upper translation cam supporting portion 235 is disposed between the right color guide grooves 236 and in a substantially center portion of the upper end portion of the right process side plate 231R in the front-rear direction.

The lower translation cam supporting portion 235 is arranged in a substantially center portion of the right process side plate 231R in the up-down direction, and protrudes rightward from the right surface of the right process side plate 231R and then is bent upward. Further, the lower translation cam 235 is formed from the right black guide groove 227 side to the rear end portion of the right process side surface 231R so as to pass a portion below the front and rear color guide grooves 236.

The relay gear 239 is arranged on an upper side of the rear end portion of the lower translation cam supporting portion 235, and rotatably supported by a relay supporting shaft protruding rightward from the right surface of the right process side plate 231R.

Figure 16:
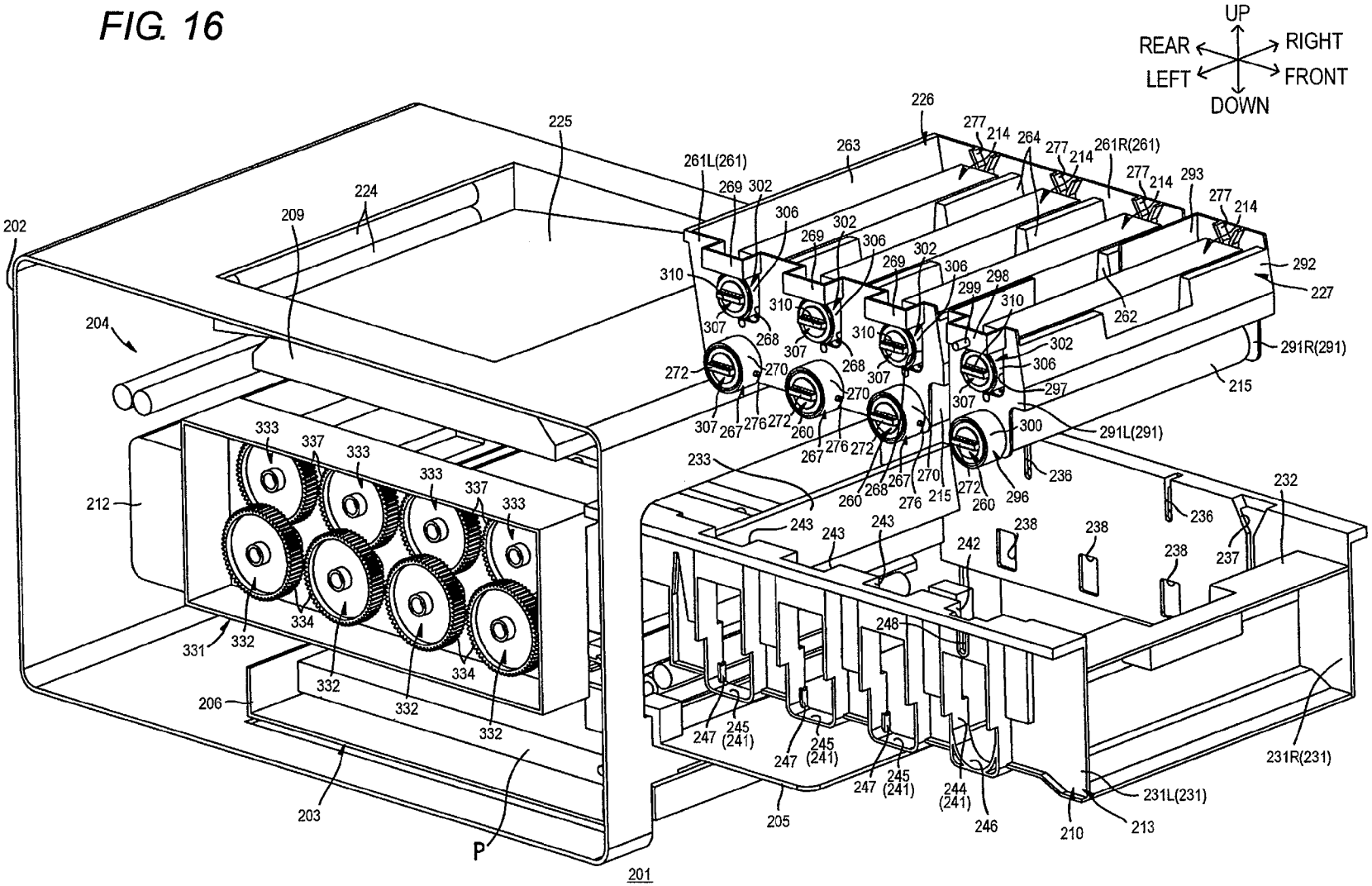
FIG. 16 is a perspective view of the color laser printer shown in FIG. 14 viewed from a left front side of the color laser printer.

As shown in FIGS. 14 and 16, the left process side plate 231L has four coupling exposing openings 241, one left black guide groove 242, and three left color guide grooves 243.

Each of the coupling exposing openings 241 is formed to have a substantially rectangular shape in side view in a substantially entire portion of the left process side plate 231L in the up-down direction. The coupling exposing openings 241 are arranged in parallel with and spaced from one another so as to correspond to the respective photosensitive drums 215 and the respective developer cartridge 214. Drum coupling portions 267 of the color unit 226 and drum coupling portion 296 of the black unit 227, developing coupling exposing openings 268 of the color unit 226 and a developing coupling exposing opening 297 of the black unit are exposed from the respective coupling exposing openings 241 toward the left side.

The coupling exposing openings 241 include a black coupling exposing opening 244 corresponding to black and color coupling exposing openings 245 corresponding to colors other than black, i.e., yellow, magenta and cyan.

The black coupling exposing opening 244 includes a positioning plate 246 provided at a lower end portion of the black coupling exposing opening 244.

Figure 19:
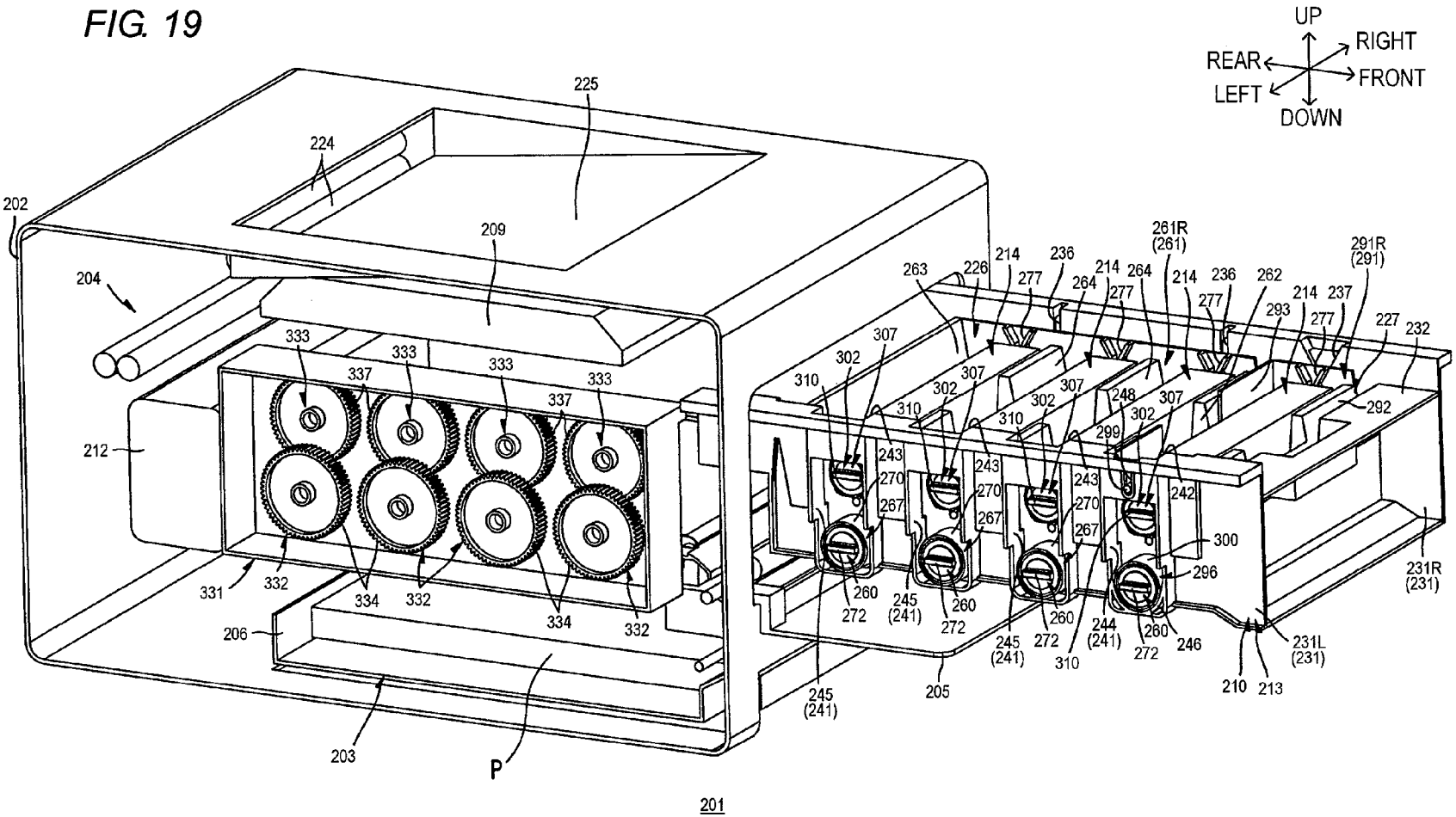
FIG. 19 is a perspective view of the laser printer shown in FIG. 18 viewed from the left front side of the color laser printer.

The positioning plate 246 has a substantially U-shape opened upward in side view so as to follow a circumference surface of the drum coupling portion 296 of the black unit 227, and is integrally formed with the left process side plate 231L in the black coupling exposing opening 244. As shown in FIG. 19, the positioning plate 246 accepts the drum coupling portion 296 from above when the black unit 227 is attached to the process frame 213.

Each of the color coupling exposing openings 245 includes front and rear supporting portions 247 provided at a lower end portion of the corresponding color coupling exposing opening 245.

Figure 22:
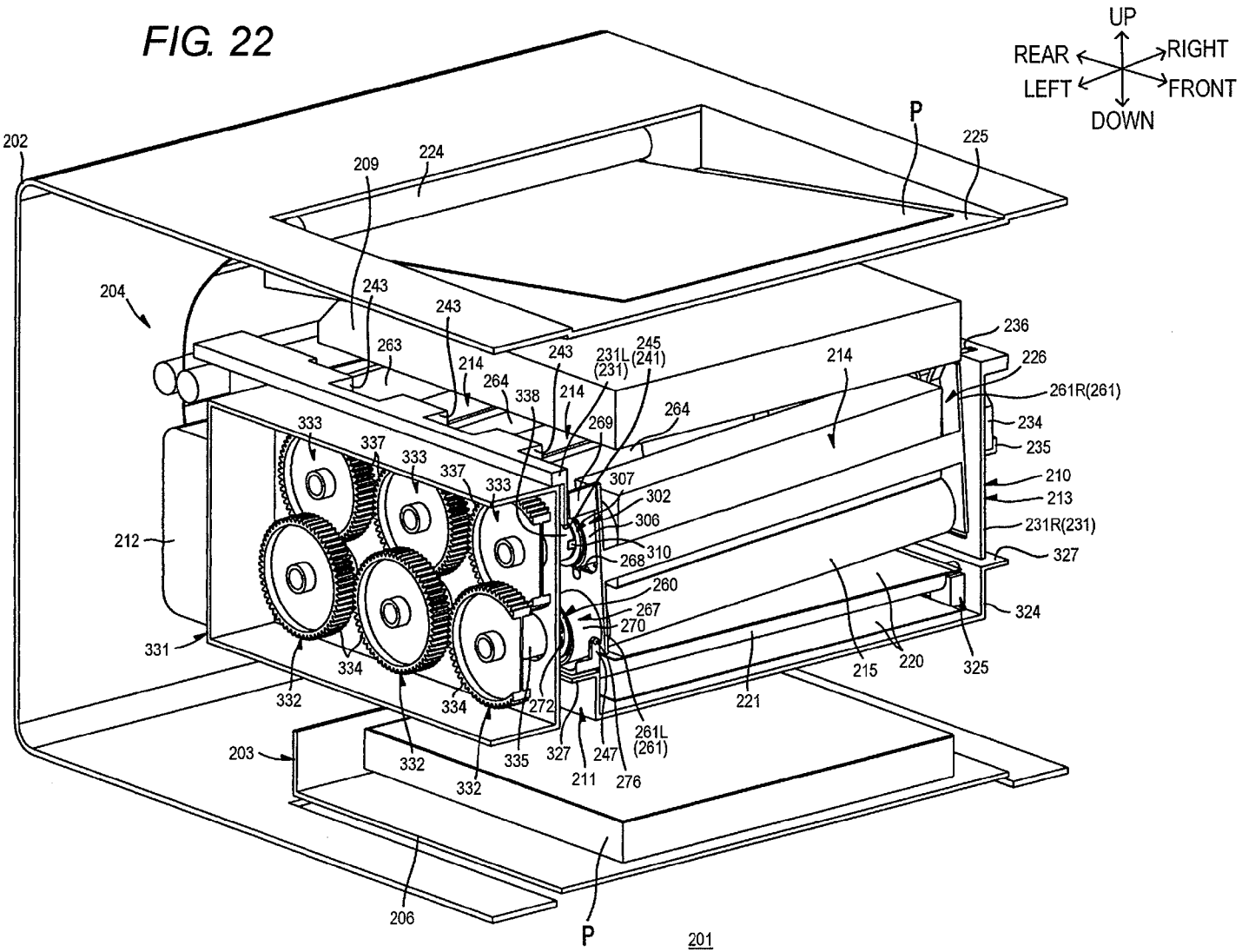
FIG. 22 is a perspective cross-sectional view of the color laser printer shown in FIG. 21 viewed from the left front side of the color laser printer.

The front and rear supporting portions 247 have substantially rectangular shapes in plan view and protrude from a front inner surface and a rear inner surface toward an inside of the color coupling exposing opening 245, respectively. An upper end portion of each of the front and rear supporting portions 247 are cut out so as to have a substantially V-shape opened upward. As shown in FIG. 22, each of the front and rear supporting portions 247 accepts a support protrusion 276 when the black unit 227 is attached to the process frame 213.

The left black guide groove 242 and the left color guide grooves 243 are cuts, each of which has a concave shape recessed leftward from an inner surface and extends downward from an upper end of the left process side plate 231L so as to have a substantially rectangular shape in side view. Further, the left black guide groove 242 and the left color guide grooves 243 are arranged to overlap the respective coupling exposing openings 241 when projected in the right-left direction. A front inner surface, a rear inner surface and a lower inner surface of each of the left black guide groove 242 and the left color guide grooves 243 are shared with the coupling openings 241.

The left process side plate 231R has a black positioning groove 248 formed on an upper side of the black coupling exposing opening 244.

The black positioning groove 248 is a cut extending downward from an upper end of the left black guide groove 242 and having a substantially Y-shape opened upward in side view.

The process front beam 232 bridges between front end portions of the process side plates 231 and has a substantially U-shape opened frontward in side cross-sectional view.

The process rear beam 233 bridges rear portions of the process side frames 231 and has a substantially V-shape opened downward in side cross-sectional view.

As shown in FIGS. 14 and 15, the translation cam 234 is a flat plate of a substantially rectangular shape in side view. The translation cam 234 has a length in the up-down direction substantially the same as an interval between the cam supporting portions 235 in the up-down direction.

The translation cam 234 includes a rack portion 251, and front and rear cam portions 252 serving as an example of a first guide portion.

The rack portion 251 is protrudes rearward from a lower rear end portion of the translation cam 234, and has a length in the front-rear direction slightly longer than that of each of the cam portions 252. The rack portion 251 includes gear teeth formed in an upper end portion of the rack portion 251 entirely in the front-rear direction, such that the rack portion 251 meshes with the relay gear 239 from below.

The front and rear cam portions 252 are provided in a front portion and a rear portion of the translation cam 234, respectively. Each of the cam portions 252 includes a fixing portion 253, an opened portion 258 and a displacing portion 254.

The fixing portion 253 has a cut-out portion 255, which having a rectangular shape in side view and formed in a substantially center portion of the fixing portion 253 in the up-down direction so as to extend frontward from a rear end portion of the fixing portion 253. The cut-out portion can accept a color guide shaft 265 from rear side.

The opened portion 258 extends from a rear end of the fixing portion 253 in the front-rear direction so as to be continuous with a lower end portion of the fixing portion 253.

The displacing portion 254 is continuous with a rear end of the opened portion 258 and has a substantially trapezoid shape in side view. The displacing portion 254 includes an inclined portion 256 and a horizontal portion 257. The inclined portion 256 is continuous with an upper end of the opened portion 258 and inclines upward from the front side toward rear side. The horizontal portion 257 is continuous with a rear end of the inclined portion 256 and extends rearward.

An upper end portion of the translation cam 234 is fitted to the upper translation cam supporting portion 235 from below, and a lower end portion of the translation cam 234 is fitted to the lower translation cam supporting portion 235 from above. Accordingly, the translation cam 234 is supported between the upper and lower translation cam supporting portions 235 such that the translation cam 234 can reciprocate by sliding in the front-rear direction.

(2) Color Unit

As shown in FIG. 14, the color unit 226 has a substantially rectangular frame shape in plan view which is narrower in the front-rear direction and in the right-left direction than the process frame 213. As described above, the color unit 226 integrally supports the yellow, magenta and cyan photosensitive drums 215, the corresponding charging rollers 216 and the corresponding developer cartridges 214.

The color unit 226 includes a pair of color side plates 261, a color front beam 262, a color rear beam 263 and a plurality of, e.g., two partition beams 264.

Each of the color side plates 261 has a substantially rectangular shape in side view. As used herein, when the right side and left side are identified for the color side plates 261, one of the color side plates 261 which is located on the right side is referred to as a right color side plate 261R, and the other of the color side plates 261 which is located on the left side is referred to as a left color side plate 261L.

The right color side plate 261R includes a pair of front and rear color guide shafts 265 as an example of a pressed portion and a plurality of, e.g., three developing guide rails 277 (see FIG. 16). Further, the right color side plate 261R has a plurality of, e.g., three right drum shaft inserting holes 266.

Each of the color guide shafts 265 is a protrusion having a substantially cylindrical shape protruding rightward from a right surface of the right color side plate 261R. One front color guide shaft 265 and one rear color guide shaft 265 are provided at a front end portion and a rear end portion of the right color side plate 261R, respectively, in an upper end portion of the right color side plate 261R, so as to correspond to the respective right color guide grooves 236. Each of the color guide shafts 265 has a length in the right-left direction so as to be positioned on a right side of a right surface of the translation cam 234.

Each of the developing guide rails 277 includes a pair of front and rear protrusions which are spaced from each other in the front-rear direction, and protrudes leftward from a left surface of the right color side plate 261R. The protrusions of each of the developing guide rails 277 define a groove having substantially Y-shape in side view configured to accept a developing guide shaft 301 of the developer cartridge 214. The developing guide rails 277 are arranged in parallel with and spaced from one another in the front-rear direction so as to correspond to the respective developer cartridges 214.

Each of the right drum shaft inserting holes 266 has a substantially circular shape in side view. The right drum shaft inserting holes 266 are arranged in parallel with and spaced from one another in the front-rear direction in a lower end portion of the right color side plate 261R so as to correspond to the respective photosensitive drums 215. Each of the right drum shaft insertion holes 266 has a diameter slightly larger than that of the drum shaft 281 of the photosensitive drum 215.

As shown in FIG. 16, the left color side plate 261L includes a plurality of, e.g., three drum coupling portions 267, a plurality of, e.g., three developing coupling fitting holes 268 and a plurality of, e.g., three protruding portions 269.

Each of the drum coupling portions 267 includes a drum coupling cover 270 and a drum relay coupling 260.

The drum coupling cover 270 has a cylindrical shape protruding leftward from a left surface of the left side plate 231L, and includes a pair of front and rear supporting protrusions 276.

Each of the supporting protrusions 276 has a substantially cylindrical shape. The front supporting protrusion 276 protrudes frontward from a front end of the drum coupling cover 270. The rear supporting protrusion 276 protrudes rearward from a rear end of the drum coupling cover 270.

In a portion of the left side plate 231L inside the drum coupling cover 270 in left side view, a left drum shaft inserting hole 275 (see FIG. 20) configured to accept the drum shaft 281 is formed.

The drum relay coupling 260 is movably fitted in the drum coupling cover 270 (see FIG. 20).

Figure 17:
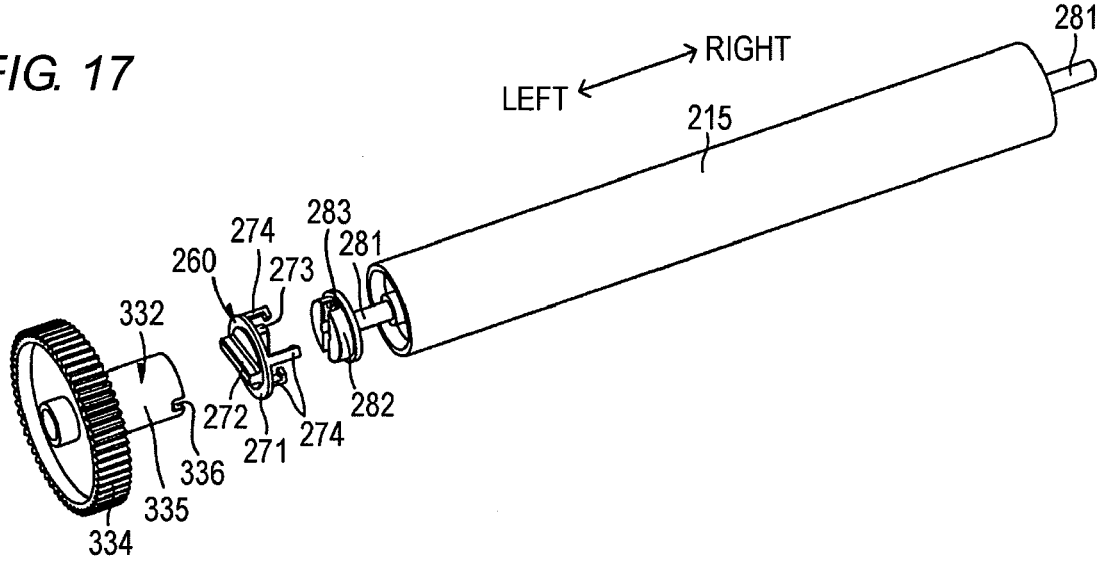
FIG. 17 is an exploded perspective view of a left end portion of the photosensitive drum shown in FIG. 16.

As shown in FIG. 17, the drum relay coupling 260 includes a base portion 271, a main body protrusion 272, a drum protrusion 273 and a plurality of, e.g., three, hook portions 274 which are integrally formed.

The base portion 271 has a circular disk shape having a diameter slightly smaller than that of the drum coupling cover 270.

The main body protrusion 272 is a protrusion formed on a left surface of the base portion 271 so as to extend along a diameter direction of the base portion 271. The main body protrusion 272 has a length smaller than a diameter of the base portion 271.

The drum protrusion 273 is a protrusion formed on a right surface of the base portion 271 so as to extend perpendicular to the main body protrusion 272 when the drum relay coupling 270 is projected along the right-left direction. The drum protrusion 273 is formed along the diameter direction of the base portion 271 so as to have a length smaller than the diameter of the base portion 271.

Each of the hook portions 274 is arranged on a circumference edge of the base portion 271 so as to be spaced at substantially 120 degrees from adjacent hook portions 274. Each of the hook portions 274 has a hook shape which protrudes rightward from the circumference edge of the base portion 271 and then is bent inward in the diameter direction of the base portion 271.

As shown in FIG. 16, the developing coupling fitting holes 268 are formed in and penetrates the left color side plate 261L so as to have substantially rectangular shapes in side view to accept respective developing coupling portions 302.

Each of the protruding portions 269 has a rectangular frame shape in plan view which protrudes leftward from a left surface of the left color side plate 261L in an upper end portion of the left color side plate 261L. Each of the protruding portions 269 is opened rightward. A length of each of the protruding portions 269 in the front-rear direction is slightly longer than that of the corresponding developing coupling portion 302. A left end portion of each of the protruding portions 269 is positioned on a left side of the corresponding developing coupling portion 302. Accordingly, each of the protruding portions 269 allows the developing coupling portion 302 to pass therein along the up-down direction.

The color front beam 262 bridges front end portions of the color side plates 261 and has a substantially V-shape opened forward in side cross-sectional view.

The color rear beam 263 bridges rear end portions of the color side plates 261 and has a flat plate shape extending in the up-down direction and straight in the side cross-sectional view.

The two partition walls 264 bridge the color side plates 261 so as to be arranged in parallel with and spaced from each other in the front-rear direction, between the color front beam 262 and the color rear beam 263. Each of the partition walls 264 has a substantially V-shape opened downward in a side cross-sectional view. Consequently, a space defined (enclosed) by the color front beam 262, the color rear beam 263 and the color side plates 261 is partitioned into three regions (substantially equal space) in the front-rear directions by the two partition walls 264.

As shown in FIG. 17, the drum shaft 281 supporting the photosensitive drum 215 is inserted into the photosensitive drum 215, and a first drum coupling 282 is formed on a left end portion of the drum shaft 281.

The drum shaft 281 is inserted so as to extend coaxially with the photosensitive drum 215 such that a relative rotation between the drum shaft 281 and the photosensitive drum 215 is avoided.

As shown in FIG. 20, the left end portion of the drum shaft 281 is inserted into the left drum shaft inserting hole 275 and arranged inside the drum coupling cover 270.

As shown in FIG. 14, a right end portion of the drum shaft 281 is inserted into the right drum shaft inserting hole 266. The right end portion of the drum shaft 281 protrudes rightward from the right color side plate 261 so as to be positioned on a left side of the left surface of the right process side plate 231R when the color unit 226 is attached to the process frame 213.

The first drum coupling 282 has a circular disk shape having a diameter smaller than that of the base portion 271 of the drum relay coupling 260 so as to be engaged with the hook portion 274, such that a relative rotation between the first drum coupling 282 and the drum shaft 281 is avoided. The first drum coupling 282 includes a first groove 283 extending in an entire diameter of the first drum coupling 282 so as to accept the drum protrusion 273.

Further, the first drum coupling 282 is engaged with the hook portion 274 in the drum coupling cover 270 in a state in which the drum protrusion 273 is fitted in the first groove 283. Consequently, the first drum coupling 282 is fitted to the drum relay coupling 260 while a relative rotation between the first drum coupling 282 and the drum relay coupling 260 is avoided.

(3) Black Unit

As shown in FIG. 14, the black unit 227 has a substantially rectangular frame shape extending in the right-left direction in plan view, and includes the black photosensitive drum 215, the charging roller 216 and the developer cartridge 214 as described above.

The black unit 227 includes a pair of right and left black side plates 291, a black front beam 292 and a black rear beam 293.

Each of the black side plates 291 has a substantially rectangular shape in side view. As used herein, when the right side and left side are identified for the black side plates 291, one of the black side plates 291 which is located on the right side is referred to as a right black side plate 291R, and the other of the black side plates 291 which is located on the left side is referred to as a left black side plate 291L.

The right black side plate 291R includes a right black guide shaft 294 and a developing guide rail 277 (see FIG. 16). Further, the right black side plate 291R has a right drum shaft inserting hole 295.

Similar to the developing guide rails 277 of the color unit 226, the developing guide rail 277 includes a pair of front and rear protrusions which are spaced from each other in the front-rear direction, and protrudes leftward from a left surface of the right black side plate 291R. The protrusions of the developing guide rails 277 define a groove having substantially Y-shape in side view configured to accept the developing guide shaft 301 of the developer cartridge 214.

The black guide shaft 294 is a protrusion having a substantially cylindrical shape protruding rightward from a right surface of the right black side plate 291R. One front black guide shaft 294 and one rear black guide shaft 294 are provided at a front end portion and a rear end portion of the black color side plate 291R, respectively, in an upper end portion of the right black side plate 291R. The black guide shaft 294 has a length in the right-left direction such that a right end portion of the black guide shaft 294 is fitted in the right black guide groove 237.

The right drum shaft inserting hole 295 has a substantially circular shape in side view. The right drum shaft inserting hole 295 is arranged in parallel with and spaced from the right black guide shaft 294 in the front-rear direction in a lower end portion of the right black side plate 291R. The right drum shaft insertion hole 295 has a diameter slightly larger than that of the drum shaft 281 of the photosensitive drum 215.

As shown in FIG. 16, the left black side plate 291L includes a drum coupling portion 296, a developing coupling fitting hole 297, a protruding portion 298 and a left black guide shaft 299.

The drum coupling portion 296 includes a drum coupling cover 300 and a drum relay coupling 260, similar to the drum coupling portion 267 of the color unit 226.

The drum coupling cover 300 has a cylindrical shape protruding leftward from the left surface of the left side plate 231L. In a portion of the left black plate 291L inside the drum coupling cover 300 in left side view, a left drum shaft inserting hole (not shown) configured to accept the drum shaft 281 is formed.

The drum relay coupling 260 is movably fitted in the drum coupling cover 300.

As shown in FIG. 16, the developing coupling fitting hole 297 are formed in and penetrates the left black side plate 291L so as to have a substantially rectangular shape in side view to accept the developing coupling portion 302.

The protruding portion 298 has a rectangular frame shape in plan view which protrudes leftward from a left surface of the left black side plate 291L in an upper end portion of the left black side plate 291L. The protruding portion 298 is opened rightward. A length of the protruding portion 298 in the front-rear direction is slightly longer than that of the developing coupling portion 302. A left end portion of the protruding portion 298 is positioned on a left side of the developing coupling portion 302. Accordingly, the protruding portion 269 allows the developing coupling portion 302 to pass therein along the up-down direction.

The black front beam 292 bridges front end portions of the black side plates 291 and has a substantially V-shape opened downward in side cross-sectional view.

The color rear beam 293 bridges rear end portions of the black side plates 291 and has a flat plate shape extending in the up-down direction and straight in the side cross-sectional view.

Similar to the color unit 226, in the black unit 227, as shown in FIG. 20, the left end portion of the drum shaft 281 of the black photosensitive drum 215 is inserted into the left drum shaft inserting hole (not shown) of the left black side plate 291L and arranged inside the drum coupling cover 300.

As shown in FIG. 14, a right end portion of the drum shaft 281 is inserted into the right drum shaft inserting hole 295. The right end portion of the drum shaft 281 protrudes rightward from the right black side plate 291R so as to be fitted in the right black guide groove 237 and positioned on a right side of the right surface of the right process side plate 231R when the black unit 227 is attached to the process frame 213.

The first drum coupling 282 of the black photosensitive drum 215 engaged with the hook portion 274 in a state in which the drum protrusion 273 is fitted in the first groove 283 in the drum coupling cover 300. Accordingly, the first drum coupling 282 is movably fitted in the drum relay coupling 260 such that a relative rotation between the first drum coupling 282 and the drum relay coupling 260 is avoided.

(4) Developer Cartridge

As shown in FIGS. 14 and 16, the developer cartridge 214 can be detachably attachable to the color unit 226 or the black unit 227. The developer cartridge 214 includes the developing roller 217, a developing guide shaft 301 and the developing coupling portion 302.

Figure 23:
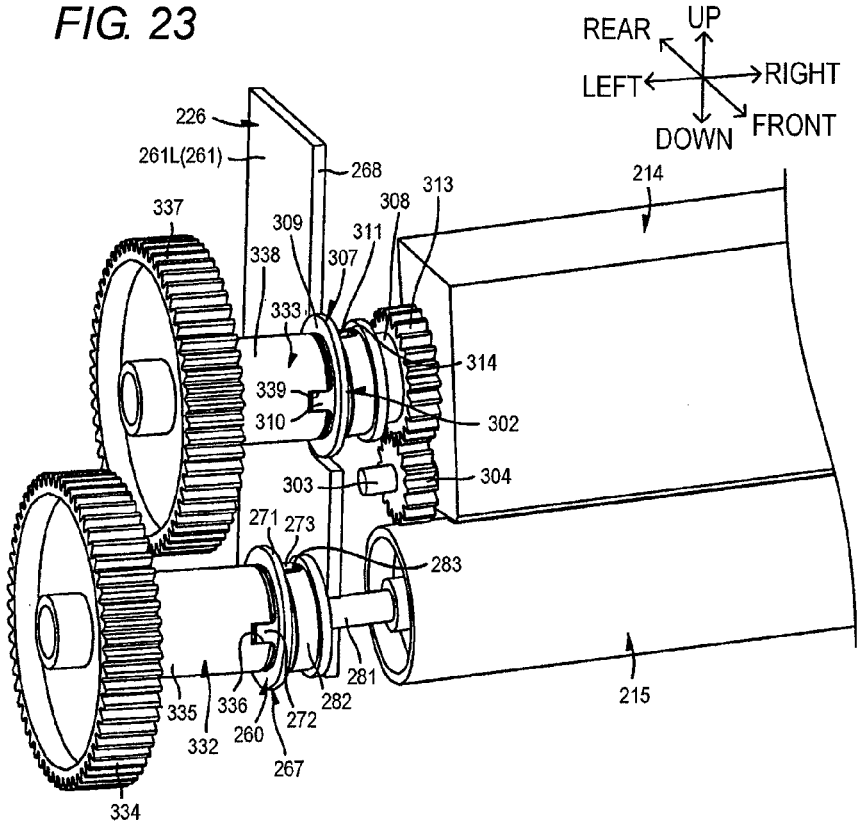
FIG. 23 is a diagram explaining a drive transmission of a drum coupling portion and a developing coupling portion when the color unit shown in FIG. 21 is swung, in a sate in which a drum protrusion extends along an up-down direction, in which a drum coupling cover and a developing coupling cover are not shown.

The developing roller 217 includes a developing roller shaft 303 and a developing roller drive gear 304 (see FIG. 23).

The developing roller shaft 303 passes the developing roller 217 and rotatably supported by the developer cartridge 214 so as to be coaxially with the developing roller 217 (see FIG. 20).

The developing roller drive gear 304 is provided in a left end portion of the developing roller shaft 303 and outside the developer cartridge 214, such that a relative rotation between the developing roller drive gear 304 and the developing roller shaft 303 is avoided (see FIG. 23).

The developing guide shaft 301 has a cylindrical shape protruding rightward from an upper portion of the left surface of the developer cartridge 214.

The developing coupling portion 302 is provided on a right end portion of the developer cartridge 214 and is configured to transmit a driving force to the developing drive gear 304. The developing coupling portion 302 includes a developing coupling cover 306, a developing relay coupling 307 and a first developing coupling 308.

The developing coupling cover 306 has a cylindrical shape protruding leftward from a left surface of the developer cartridge 214.

The developing relay coupling 307 is movably fitted in the developing coupling cover 306 and includes a base portion 309, a main body protrusion 310, a developing protrusion 311 and hook portions 312 (see FIG. 20), similar to the drum relay coupling 260 including the base portion 271, the main body protrusion 272, the drum protrusion 273 and the hook portions 274.

The first developing coupling 308 has a circular disk shape and rotatably supported at a left end portion of the developer cartridge 214 by a first developing coupling supporting shaft 315 protruding leftward from the left surface of the developer cartridge 214 (see FIG. 20). The first developing coupling 308 includes: gear teeth 313 provided in a right side circumference edge thereof so as to mesh with the developing roller drive gear 304; and a first groove 314 formed on a left end thereof and extending in an entire diameter thereof so as to be fitted with the developing protrusion 311 of the developing relay coupling 307.

The first developing coupling 308 is engaged with the hook portions 312 in the developing coupling cover 306 in a state in which the developing protrusion 311 is fitted in the first groove 314. Consequently, the first developing coupling 308 is movably, but not relative-rotatably, fitted to the developing relay coupling 307.

Each of the developer cartridges 214 is mounted to the color unit 226 from above such that the developing roller 217 is located in a lower portion thereof. When each of the developer cartridges 214 is mounted to the color unit 226, the developing coupling portion 302 is fitted in the developing coupling fitting hole 268 of the left side color plate 261L, and the developing guide shaft 301 and the developing roller shaft 303 are fitted in the developing guide rail 277 formed in the right color side plate 261R.

Similarly, the developer cartridge 214 is mounted to the black unit 227 from above such that the developing roller 217 is located in a lower portion thereof. When the developer cartridge 214 is mounted to the black unit 227, the developing coupling portion 302 is fitted in the developing coupling fitting hole 297 of the left side black plate 291L, and the developing guide shaft 301 and the developing roller shaft 303 are fitted in the developing guide rail 277 formed in the right black side plate 291R.

Each of the developer cartridges 214 can be separated from the color unit 226 and the black unit 227 by removing upward each of the developer cartridges 214.

2.3. Details of Main Body Casing

As shown in FIG. 14, the fixing unit 212 includes a translation cam drive member 321. The translation cam drive member 321 configures a separation mechanism, together with the translation cam 235, the translation cam supporting portion 235, the right color guide groove 236 and the relay gear 239.

The translation cam drive member 321 is integrally formed with the fixing unit 212 on the left upper portion thereof. The translation cam drive member 321 is a flat plate having a substantially L-shape in side view which extends upward and then is bent frontward. The translation cam drive member 321 includes a drive gear supporting shaft 322 and drive gear 323.

The drive gear supporting shaft 322 has a cylindrical shape extending leftward from a front end portion of the translation cam drive member 321.

The drive gear 323 is rotatably supported by the drive gear shaft 322 on a left side of a front end portion of the translation cam drive member 321 so as to mesh with the relay gear 239.

As shown in FIGS. 14 and 20, the transfer unit 211 includes a frame 324 a plurality of, e.g., four, pairs of transfer roller supporting members 325, a plurality of, e.g., four, pairs of compression springs 326 serving as an example of a urging member, and a plurality of, e.g., four, pairs of transfer roller stoppers 327.

The frame 324 has a tray shape extending in the front-rear direction and the right-left direction, and stores the transfer rollers 321.

The transfer roller supporting members 325 of each pair are provided on a left and right sides of the frame 324, so as to correspond to the corresponding transfer roller 221. Each of the transfer roller supporting portions 325 has a substantially rectangular shape in the front cross-sectional view. The transfer roller supporting portions 325 rotatably supports both end portions of the transfer roller shafts 328 of the transfer rollers 221.

Each of the transfer roller supporting portions 325 has: an inserting hole 329 configured to rotatably accept the transfer roller shaft 328; and a compression spring storing portion 330 configured to store the compression spring 326. The inserting hole 329 penetrates an upper portion of the transfer roller supporting portion 325 in the right-left direction. The compression spring storing portion 330 is formed to have a substantially rectangular shape in front cross-sectional view, by cutting the lower portion of the transfer roller supporting portion 325 so as to extend upward from a lower end of the lower portion of the transfer roller supporting portion 325.

An upper end portion of the compression spring 326 is stored in the compression spring storing portion 330, and a lower end portion of the compression spring 326 is connected to the frame 324 of the transfer unit 211. Consequently, the transfer roller supporting portions 325 are always urged upward.

The transfer roller stoppers 327 of each pair are protrusions which protrude from upper ends of right and left sides of the frame 324, respectively, and which extend in the front-rear direction. The transfer roller stoppers 327 of each pair contact the corresponding one of the transfer rollers 328 from above. Consequently, an upward movement of each of the transfer rollers 221 is regulated.

The main body casing 202 includes a drive input portion 131 as shown in FIG. 16.

The drive input portion 131 includes a second drum coupling 332 and a second developing coupling 333. The second drum coupling 332 and the second developing coupling 333 are movable along the right-left direction by an advancing-retracting mechanism (not shown).

As shown in FIG. 17, the second drum coupling 332 includes a gear portion 334 and a fitting portion 335. The gear portion 334 is configured to receive a drive force from a motor (not shown). The fitting portion 335 is provided coaxially with the gear portion 334 and configured to accept the main body protrusion 272 of the drum relay coupling 260.

The gear portion 334 is provided on the left side of the second drum coupling 332 so as to have a circular disc shape having a diameter larger than that of the photosensitive drum 215. Gear teeth are formed on a circumference portion of the gear portion 334.

The fitting portion 335 extends rightward from a right surface of the gear portion 334 and has a cylindrical shape having a diameter substantially the same as a length of the main body protrusion 272. In a right end portion of the fitting portion 335, a second groove 336 configured to accept the main body protrusion 272 is formed in an entire diameter of the fitting portion 335.

The second developing coupling 333 includes a gear portion 337 and a fitting portion 338 having a second groove 339, similar to the second drum coupling 332 including the gear portion 334 and the fitting portion 335 having the second groove 336.

1.4. Attachment of Process Unit to Main Body Casing

When the process unit 210 is attached to the main body casing 202, at first, the color unit 226 and the black unit 227, to which the developer cartridges 214 are attached, are attached to the process frame 213. Thereafter, the process frame 213 (process unit 210) storing the color unit 226 and black unit 227 are inserted into the main body casing 202.

When the color unit 226 is attached to the process frame 213, as shown in FIGS. 14 and 16, the color unit 226 is positioned such that the color guide shafts 265 are fit in the respective right color guide grooves 236 and the supporting protrusions 276 of each of the drum coupling portion 267 is fitted to the respective supporting portions 247 provided in each of the coupling exposing openings 241, and then inserted to the process frame 213 from above.

Consequently, each of the color guide shafts 265 is guided by the corresponding right color guide groove 236, and each of the drum coupling portions 267 is guided by the corresponding left color guide groove 243. Therefore, each of the color guide shafts 265 is fitted in a lower end portion of the corresponding right color guide grooves 236, and the supporting protrusions 276 of each of the drum coupling portions 267 are fitted to the supporting portions 247 of the corresponding coupling exposing opening 241. Accordingly, the attachment of the color unit 226 to the process frame 213 is completed.

Figure 18:
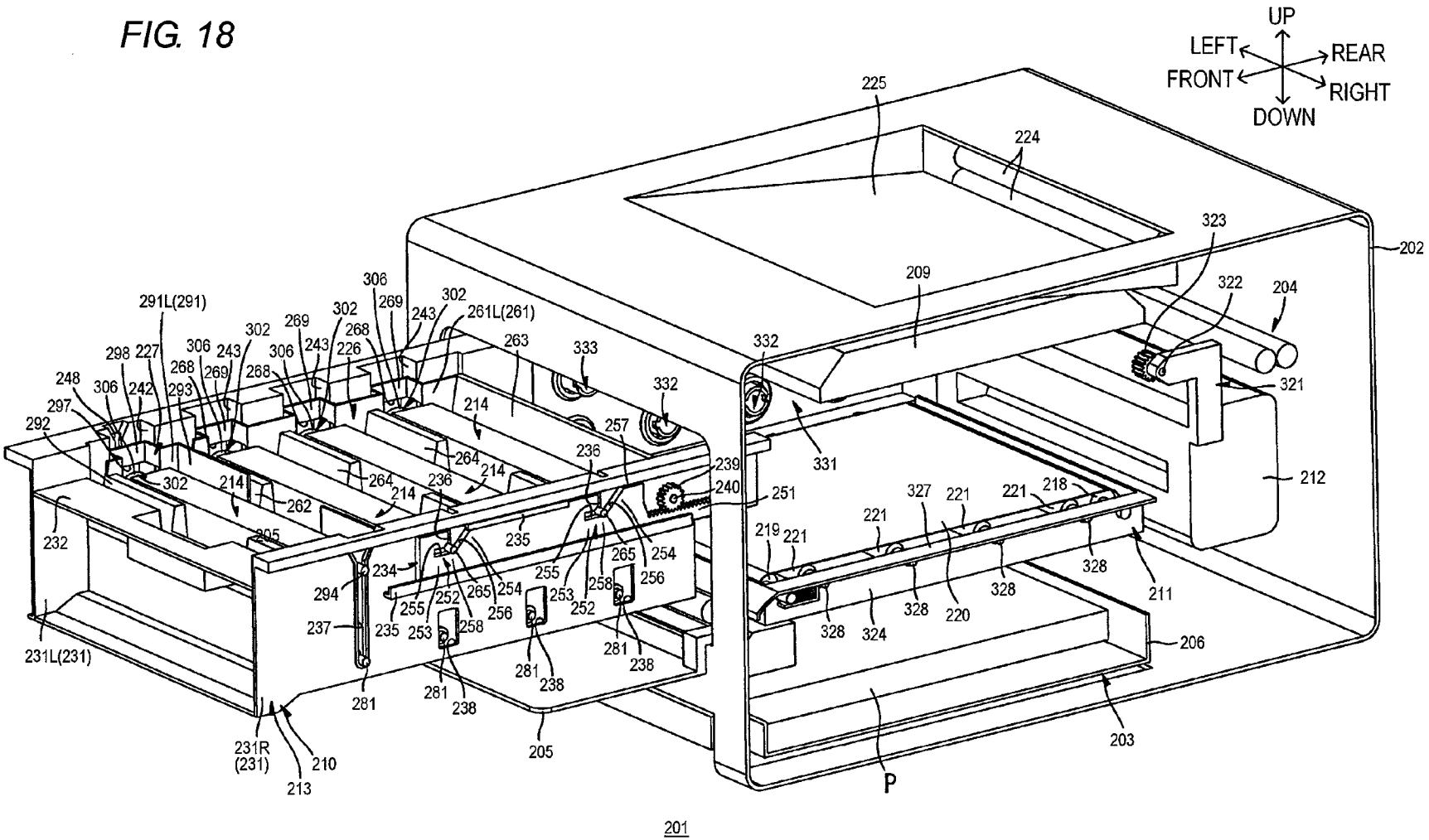
FIG. 18 is a perspective view of the color laser printer shown in FIG. 13 viewed from the right front side of the color laser printer, in a state in which the process unit is pulled out and the color unit and the black unit are attached to the process unit.

At this time, as shown in FIG. 18, the color guide shafts 265 abut the upper ends of the respective opened portions 258 of the translation cam 234 from above, and the drum shafts 281 of the photosensitive drums 215 are exposed from the respective drum shaft exposing openings 238. As shown in FIG. 19, the drum coupling portions 267 and the developing coupling portions 268 are exposed from the respective coupling exposing openings 241.

When the black unit 227 is attached to the process frame 213, as shown in FIGS. 14 and 16, the black unit 227 is positioned such that the drum shaft 281 of the photosensitive drum 215 and the right black guide shaft 294 is fit in the right black guide groove 237, such that the drum coupling portion 296 is fitted to the positioning plate 246 provided in the coupling exposing openings 241, and such that the left black guide shaft 299 is fitted in the black positioning groove 248, and then inserted to the process frame 213 from above.

Consequently, the drum shaft 281 and the right black guide shafts 294 are guided by the right black guide groove 237, and the drum coupling portion 296 is guided by the left color guide groove 242. Therefore, the drum shaft 281 is fitted in a lower end portion of the right black guide grooves 237, the drum coupling portion 296 is fitted to the positioning plate 246, and the left black guide shaft 299 is fitted in the black positioning groove 248. Accordingly, the attachment of the black unit 227 to the process frame 213 is completed.

At this time, as shown in FIG. 19, the drum coupling portion 296 and the developing coupling portion 297 are exposed from the coupling exposing opening 241.

Thereafter, a rear end portion the process unit 210 is inserted into the main body casing 202, and pushed rearward to the main body casing 202. Consequently, as shown in FIG. 20, the relay gear 239 meshes with the drive gear 323.

When the second drum coupling portions 332 advance toward the respective drum relay couplings 260 by the advancing-retracting mechanism (not shown) and then the main body protrusions 272 are fitted in the respective second grooves 336, the drum shafts 281 are connected to the respective second drum coupling portions 332 such that the relative rotations therebetween are avoided.

Similarly, when the second developing coupling portions 333 advance toward the respective developing relay couplings 255 and then the main body protrusions 310 are fitted in the respective second grooves 339, the developing roller shafts 303 are connected to the respective developing coupling portions 333 such that the relative rotations therebetween are avoided.

Accordingly, the attachment of the process unit 201 to the main body casing 202 is completed.

2.5. Operation of Process Unit

After the process unit 210 is attached to the main body casing 202, the drive force toward rear side is transmitted from the drive gear 323 to the translation cam 234 via the relay gear 230 and the rack portion 251. Consequently, the translation cam 234 is slid rearward.

Accordingly, as shown in FIG. 20, the translation cam 234 is disposed at a first position, and the color guide shafts 265 are fitted in the respective cut-out portions 255 of the fixing portions 253 of the cam portions 252, which regulates the vertical (up-down direction) movement.

Therefore, the entire widths (in the right-left direction) of all the photosensitive drums 215 contact the conveyor belt 220. Further, all the transfer rollers 221 are pressed from above by the respective photosensitive drums 215, and are positioned at the contact positions against the urging forces of the compression springs 326.

That is, the color laser printer 201 is in a color mode in which a color image is formed.

When the driving force is input to the second drum couplings 332 from the motor (not shown), the driving force is transmitted to the respective first drum couplings 282 via the respective drum relay couplings 260, whereby the photosensitive drums 215 are driven.

When the driving force is input to the second developing couplings 333, the driving force is transmitted to the respective first developing couplings 308 via the respective developing relay couplings 307. Further, when the driving force is transmitted from the first developing couplings 308 to the respective developing roller drive gears 304, the developing rollers 217 are driven.

In the color mode, when the driving force is input to the second drum couplings 332 and the second developing couplings 333, the driving force is transmitted to all the photosensitive drums 215 and all the developer cartridges 214, whereby the color image is formed.

When a frontward drive force is transmitted from the drive gear 323 to the translation cam 234 via the relay gear 239 and the rack portion 251, the translation cam 234 is slid rearward.

Consequently, the color guide shafts 265 move rearward with respect to the translation cam 234, and when the color guide shafts 265 are escaped from the cut-out portions 255, the regulation of upward movement is released. Accordingly, the pressing force applied to the transfer rollers 221 from the photosensitive drums 215 is released.

At this time, each of the transfer rollers 221 slightly moves upward by the urging force of the compression spring 326 and positioned at a position (not shown) at which a weight of the corresponding transfer roller 221 and the color unit 326 and the urging force are balanced (specifically, between the contact position and the separated position). As the transfer rollers 221 moves upward, the color unit 226 also moves upward.

Figure 21:
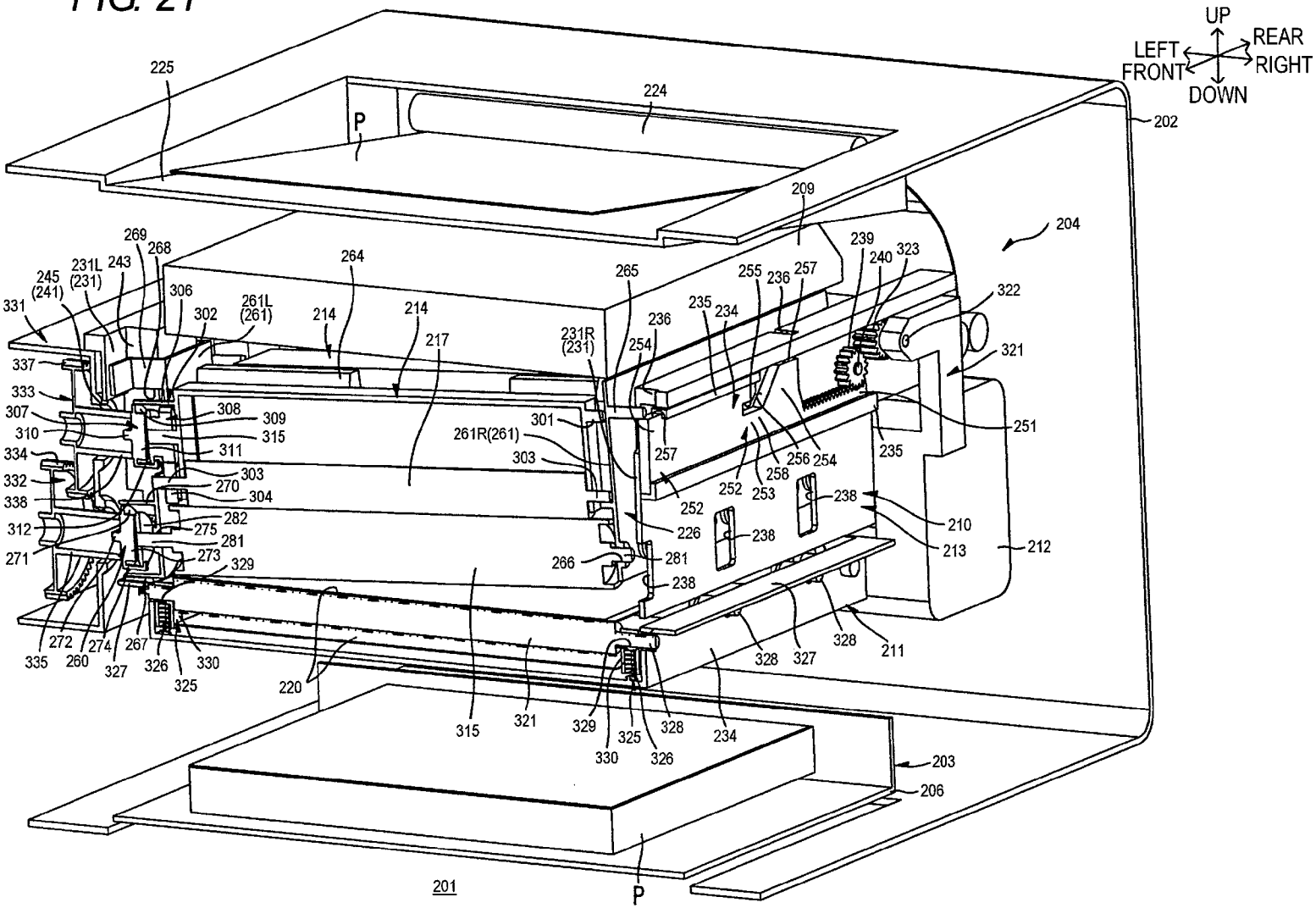
FIG. 21 is a perspective cross-sectional view of the color laser printer shown in FIG. 13 viewed from the right front side of the color printer, in a state in which the color unit is swung by sliding a translation cam in a front direction.

The translation cam 234 is further slid frontward, the color guide shafts 265 are pressed upward along the inclined portions 256 of the cam portions 252, and are guided by the right color guide grooves 236 so as to move upward. Then, as shown in FIG. 21, the color guide shafts 265 abut the horizontal portions 257 from above, and are positioned at the second positions.

At this time, as shown in FIG. 22, the yellow, magenta and cyan photosensitive drums 215 are swung in an anticlockwise direction in front view around a supporting protrusions 276 of the drum coupling portions 267 supported by the supporting portions 247 of the left process side frame 231L as pivot fulcra, while connections between the first drum couplings 282 and the respective drum relay couplings 260 and connections between the drum relay couplings 260 and the respective second drum couplings 332 are maintained.

Specifically, as shown in FIG. 23, when the drum protrusion 273 is arranged along the up-down direction, each of the yellow, magenta and cyan photosensitive drums 215 can be swung such that the lower portion of the first drum coupling 282 is slightly separated from the drum relay coupling 260 while the connection between the upper portion of the first drum coupling 282 and the drum relay coupling 260 is maintained.

Figure 24:
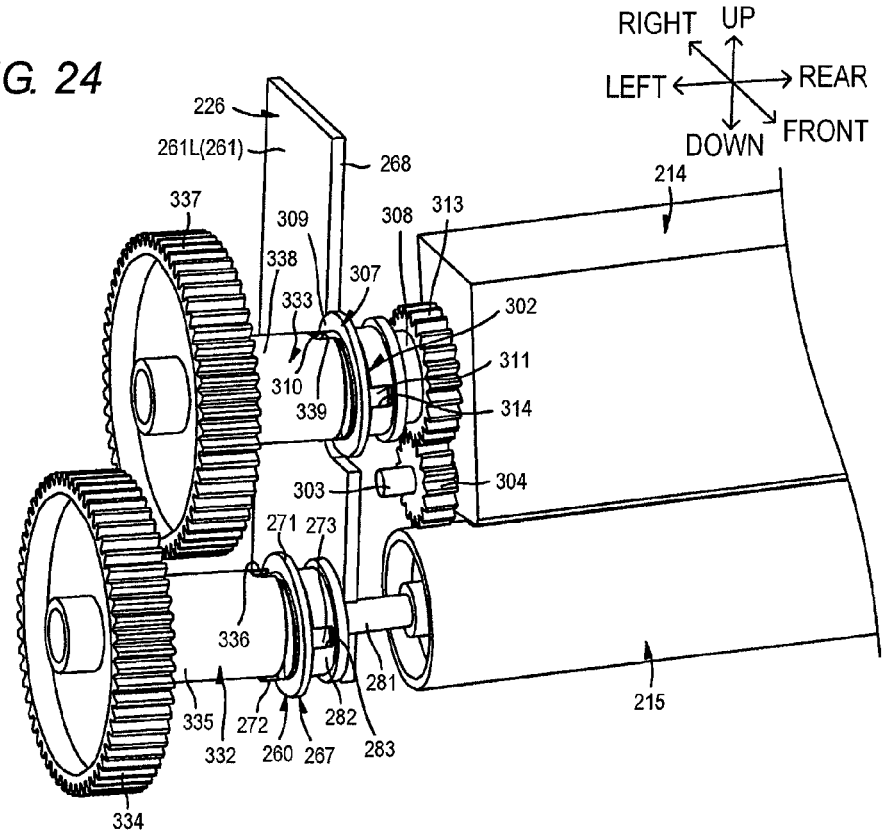
FIG. 24 is a diagram explaining the drive transmission of the drum coupling portion and the developing coupling portion when the color unit shown in FIG. 21 is swung, in a sate in which a main body protrusion extends along an up-down direction, in which a drum coupling cover and a developing coupling cover are not shown.

Further, as shown in FIG. 24, when the main body protrusion 272 is arranged along the up-down direction, each of the yellow, magenta and cyan photosensitive drums 215 can be swung such that the lower portion of the drum relay coupling 260 is slightly separated from the second drum coupling 332 while the connection between the upper portion of the drum relay coupling 260 and the second drum coupling 332 is maintained.

Figure 25:
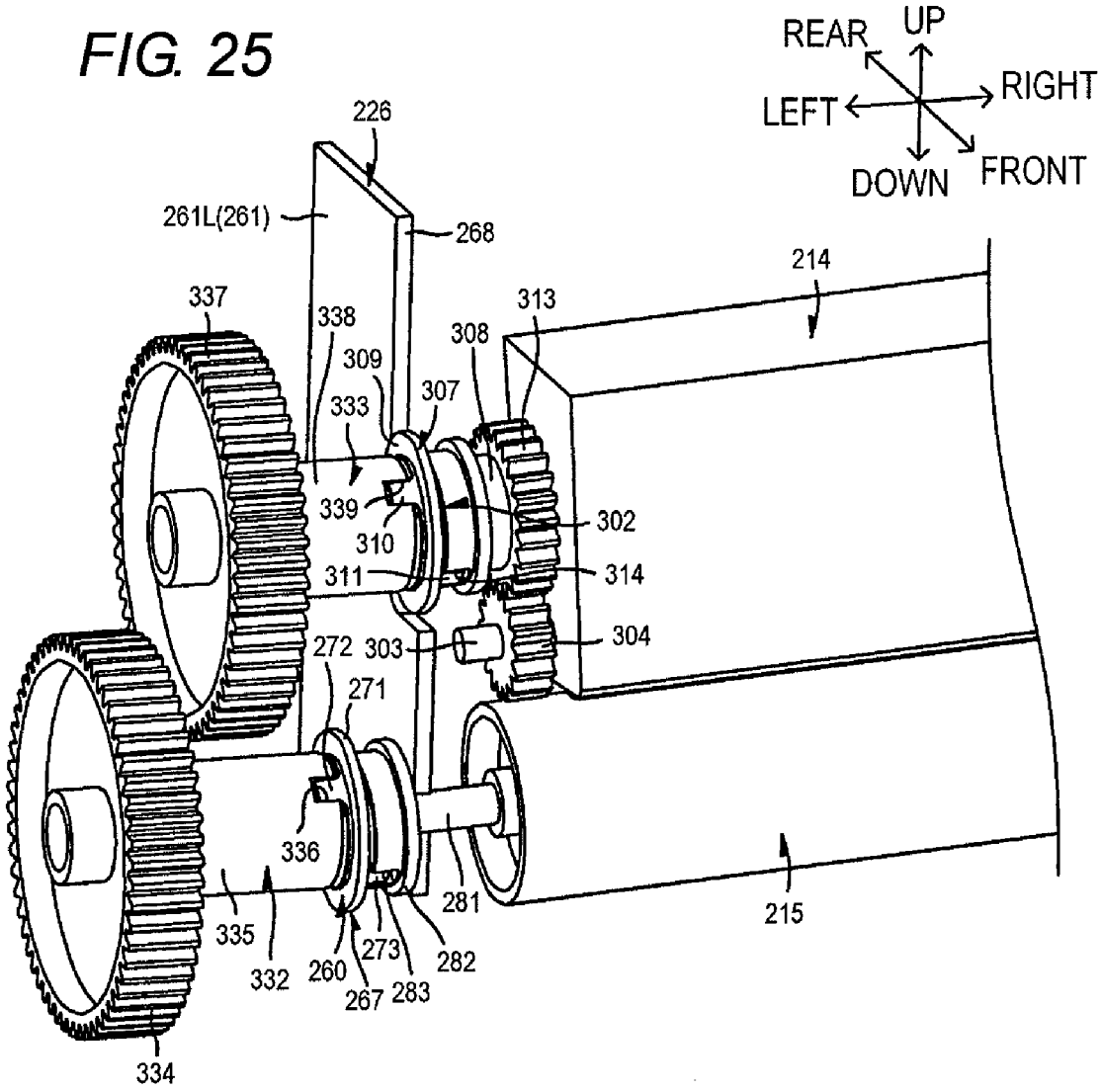
FIG. 25 is a diagram explaining the drive transmission of the drum coupling portion and the developing coupling portion when the color unit shown in FIG. 21 is swung, in a sate in which neither the drum protrusion nor the main body protrusion extends along an up-down direction, in which a drum coupling cover and a developing coupling cover are not shown.

Further, as shown in FIG. 25, when neither the main body protrusion 272 nor the drum protrusion 273 is arranged along the up-down direction, each of the yellow, magenta and cyan photosensitive drums 215 can be swung such that the lower portions of the first drum coupling 282 and the drum relay coupling 260 are slightly separated from the drum relay coupling 260 and the second drum coupling 332, respectively, while the connection between the upper portion of the first drum couplings 282 and the drum relay coupling 260 and the connection between the upper portion of the drum relay coupling 260 and the second drum coupling 332 are maintained.

That is, the connection between the drum relay coupling 260 and at least one of the first drum coupling 282 and the second drum coupling 332 is adjusted so as to be adapted to the swing movement of the photosensitive drum 215. Therefore, each of the yellow, magenta and cyan photosensitive drums 215 can be swung without releasing a drive transmission.

At this time, as shown in FIG. 21, each of the yellow, magenta and cyan developer cartridges 214 is swung in the anticlockwise direction in front view while the connection between the first developing coupling 108 and the developing relay coupling 107 and the connection between the developing relay coupling 107 and the second developing coupling 333.

Specifically, as shown in FIG. 23, when the developing protrusion 311 is arranged along the up-down direction, each of the yellow, magenta and cyan developer cartridges 214 can be swung such that the lower portion of the first developing coupling 308 is slightly separated from the developing relay coupling 307 while the connection between the upper portion of the first developing coupling 308 and the developing relay coupling 307 is maintained.

Further, as shown in FIG. 24, when the main body protrusion 310 is arranged along the up-down direction, each of the yellow, magenta and cyan developer cartridges 214 can be swung such that the lower portion of the developing relay coupling 307 is slightly separated from the second developing coupling 333 while the connection between the upper portion of the developing relay coupling 307 and the second developing coupling 333 is maintained.

Further, as shown in FIG. 25, when neither the main body protrusion 310 nor the developing protrusion 311 is arranged along the up-down direction, each of the yellow, magenta and cyan developer cartridges 214 can be swung such that the lower portions of the first developing coupling 308 and the developing relay coupling 307 are slightly separated from the developing relay coupling 307 and the second developing coupling 333, respectively, while the connection between the upper portion of the first developing coupling 308 and the developing relay coupling 307 and the connection between the developing relay coupling 307 and the second developing coupling 333 are maintained.

That is, similar to the photosensitive drums 215, the connection between the developing relay coupling 307 and at least one of the first developing coupling 308 and the second developing coupling 333 is adjusted so as to be adapted to the swing movement of the developer cartridge 214. Therefore, each of the yellow, magenta and cyan developer cartridges 214 can be swung together with the photosensitive drums 215 without releasing a drive transmission.

Further, when each of the yellow, magenta and cyan photosensitive drums 215 are swung, as shown in FIG. 21, the entire width (in the right-left direction) of the photosensitive drum 215 is separated from the conveyor belt 220. Each of the transfer rollers 221 corresponding yellow, magenta and cyan is positioned at a separated position at which the transfer roller shaft 328 contacts the transfer roller stopper 327 and which is higher than (i.e., an upper side of) the contact position (indicted by an imaginary line in FIG. 21) by the urging force of the compression spring 326.

At this time, the yellow, magenta and cyan photosensitive drums 215 are swung so as to be arranged above the separated positions of the transfer rollers 221 corresponding yellow, magenta and cyan.

Accordingly, while the entire width of the black photosensitive drum 215 contacts the conveyor belt 220, the entire widths of the yellow, magenta and cyan photosensitive drums 215 are separated from the conveyor belt 220. Therefore, the color laser printer 201 is in a monochrome mode in which a monochrome image is formed.

In the monochrome mode, in a state in which the photosensitive drums 215 other than black (i.e., the yellow, magenta and cyan photosensitive drums 215) are separated from the conveyor belt 220, when the drive force is input to the second drum coupling 332 corresponding to black and the second developing coupling 333 corresponding to black, the black image can be formed.

2.6. Effects and Advantages (1) According to the laser printer 201, as shown in FIG. 21, the color unit 226 integrally holding the color (e.g., yellow, magenta and cyan) photosensitive drums 215 and the separation mechanism (e.g., the right color guide grooves 236, the translation cam 234, the translation cam supporting portions 235, the relay gear 239 and the translation cam drive member 321) configured to press the color guide shafts 265 provided at the right end portion of the color unit 226 so as to separate the entire widths of the color photosensitive drums 215 from the conveyor belt 220.

Consequently, when the separation mechanism presses the color guide shafts 65, the entire widths of the color photosensitive drums 215 held by the color unit 226 can be separated from the conveyor belt 220.

As a result, as compared with the mechanism for separating both ends of each of the photosensitive drums 215 from the conveyor belt 220, the color photosensitive drum 215 can be separated from the conveyor belt 220 by a simplified configuration.

(2) According to the color laser printer 201, as shown in FIG. 14, the black unit 227 supporting the black photosensitive drum 215 and detachably attachable to the process frame 213 is provided.

Therefore, only the black photosensitive drum 215 can be attached to and detached from the process frame 213.

(3) According to the color laser printer 201, as shown in FIGS. 20 and 21, the translation cam 234 is movable to take the first position and the second position. The translation cam 234 at the first position allows all the photosensitive drum 215 to contact the conveyor belt 220 by releasing the press on the color guide shafts 265. The translation cam 234 at the second position allows the black photosensitive drum 215 to contact the conveyor belt 220 and also allows the entire widths of the rest of photosensitive drums 215 to be separated from the conveyor belt 220 by pressing the color guide shafts 265.

Accordingly, by the reciprocation movement of the translation cam 234 between the first position and second position, all the photosensitive drums 215 can easily and surely contact the conveyor belt 220 when the translation cam 234 is positioned at the first position, and the only the black photosensitive drum 215 can easily and surely contact the conveyor belt when the translation cam 234 is positioned at the second position.

(4) According to the color printer 201, as shown in FIGS. 20 and 21, the translation cam 234 is positioned at the first position in the color mode, and is positioned at the second position in the monochrome mode.

Therefore, the translation cam 234 can switch the mode of the color laser printer 201 between the color mode and the monochrome mode. Specifically, the translation cam 234 at the first position allows the color laser printer 201 to operate in the color mode in which the color image is formed by bringing all the photosensitive drums 215 into contact with the conveyor belt 220. Further, the translation cam 234 at the second position allows the color laser printer 201 to operate in the monochrome mode in which the monochrome image is formed by bringing only the photosensitive drum 215 configured to form the black image into contact with the conveyer belt 220.

As a result, the mode can be switched by a simplified operation, i.e., sliding the translation cam 234.

(5) According to the color laser printer 201, as shown in FIGS. 20 and 21; the color guide shaft 265 is guided by the cam portion 252 formed in the translation cam 234.

Therefore, by sliding the translation cam 234, the color unit 226 can be moved along the cam portion 252.

(6) According to the color laser printer 1, as shown in FIG. 15, in the process frame 213, the right side plate 231R includes the right color guide portion 236 configured to guide the color guide shaft 265.

Consequently, when the photosensitive drum 215 is swung by sliding the translation cam 234, it is possible to prevent the color guide shaft 265 from departing in the front-rear direction in which the translation cam 234 is slid, by guiding the color guide shaft 265 along the right color guide groove 236.

(7) According to the color laser printer 201, as shown in FIGS. 20 and 21, the right color guide groove 236 guides the color guide shaft 265 along the up-down direction.

Consequently, when the photosensitive drum 215 is swung by sliding the translation cam 234, the color guide shaft 265 can be pressed in the up-down direction perpendicular to the front-rear direction in which the translation cam 234 is slid.

As a result, the photosensitive drum 215 can reliably contact and be separated from the conveyer belt 220 along the up-down direction perpendicular to a alignment direction the photosensitive drums 215 (i.e., the front-rear direction).

(8) According to the color laser printer 201, as shown in FIG. 20, the left end portion of the color photosensitive drum 215 (the left end portion of the drum shaft 281) is supported by the left process side plate 231L of the process frame 213 via the drum coupling portion 267 of the color unit 226.

Consequently, the left end portion of the photosensitive drum 215 can easily positioned with respect to the process frame 213.

(9) According to the color laser printer 201, as shown in FIG. 22, the separation mechanism separates the photosensitive drum 215 from the conveyor belt 220 by pressing the color guide shaft 265 and swinging the photosensitive drum 215 around the supporting protrusion 276 of the drum coupling portion 267 as the pivot fulcrum.

Consequently, the photosensitive drum 215 can be separated from the conveyor belt 220 without a large positional variation of the left end portion of the photosensitive drum 215.

As a result, by inputting the drive force from the left end portion of the photosensitive drum 215, the photosensitive drum 215 can be swung and separated from the conveyor belt 220 without releasing the drive input.

(10) According to the color laser printer 201, as shown in FIG. 22, the color unit 226 can be swung around the supporting protrusion 276 supported by the supporting portion 247 of the process frame 213 as the pivot fulcrum.

Consequently, by using the process frame 213, the right end portion of the photosensitive drum 215 can be swung.

As a result, the photosensitive drum 215 can be separated from the conveyor belt 220 by more simplified configuration.

(11) According to the laser color printer 201, as shown in FIG. 21, the left end portion of the photosensitive drum 215 is disposed outside the conveyer belt 220.

Consequently, when the color unit 226 is swung about the support protrusion 276 of the drum coupling portion 267 as the pivot fulcrum, a portion of the photosensitive drum 215, which is closer to the right end than the left end portion of the photosensitive drum 215, can be separated from the conveyer drum 220.

As a result, the entire width of the photosensitive drum 215 can surely be separated from the conveyer drum 220.

(12) According to the color laser printer 201, as shown in FIG. 21, the developing roller 217 is disposed adjacent to the corresponding photosensitive drum 215 in the up-down direction, and is swung together with the corresponding photosensitive drum 215. Further, the developing coupling portion 302 configured to transmit the drive force to the developing roller 217 is formed at the left end portion of the developing roller 217.

Consequently, the drive force can be input to the left end portion of the developing roller 217 along the right-left direction by the developing coupling portion 302.

Accordingly, even when the developing roller 217 is swung together with the photosensitive drum 215, it is not necessary to provide a mechanism for releasing the drive transmission to the developing roller 217. As a result, the developing roller 217 can be swung together with the corresponding photosensitive drum 215 by the simplified configuration.

(13) According to the laser printer 201, as shown in FIG. 14, the developer cartridge 214 storing the developing roller 217 and capable of contacting and being separated from the photosensitive drum 215 is provided.

Consequently, the developer cartridge 214 can be exchanged by detaching only the corresponding developer cartridge 214 to be exchanged. Therefore, the maintenance of the developer cartridge 214 can be performed effectively.

(14) According to the color laser printer 201, the transfer roller 221 is positioned at the contact position when the corresponding photosensitive drum 215 contacts the conveyor roller 220, and is positioned at the separated position when the corresponding photosensitive drum 215 is separated from the conveyor belt 220. The separated position is located at a downstream side of the contact position in the urging direction. On the other hand, the photosensitive drum 215 is pressed upward so as to be disposed on the downstream side of the separated position in the urging direction.

Consequently, when the photosensitive drum 215 is pressed, the photosensitive drum 215 is disposed on the downstream side of the separated position of the transfer roller 221 in the urging direction, and is separated from the conveyor belt 220.

As a result, the transfer roller 221 at the contact position can securely presses the photosensitive drum 215 via the conveyor belt 220, and the transfer roller 221 at the separated position can surely separate the photosensitive drum 215 from the conveyor belt 220.

2.7. Modification of Second Exemplary Embodiment

Figure 26:
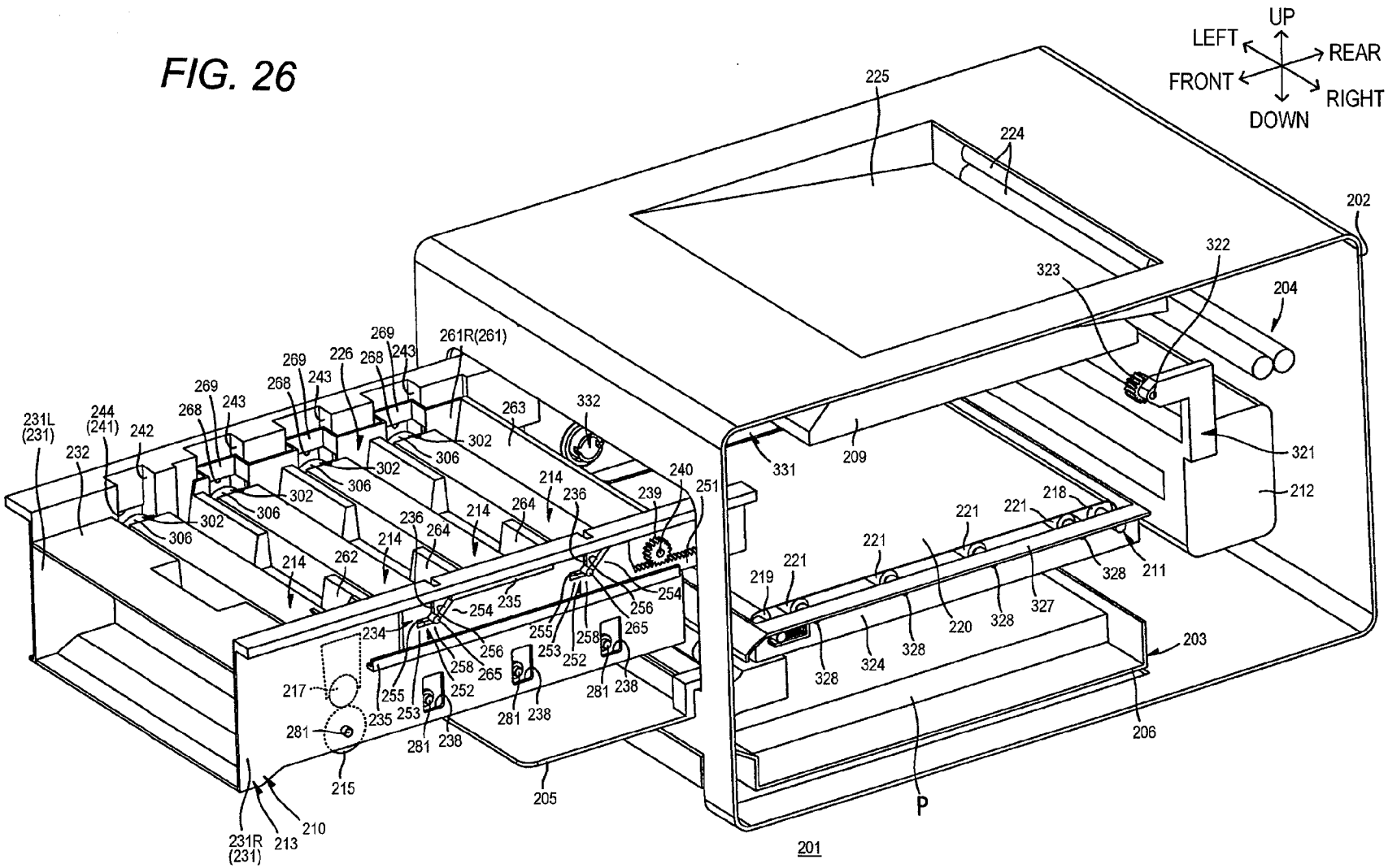
FIG. 26 is a perspective view showing an image forming apparatus viewed from a right front side of the image forming apparatus, according to a modification of the second exemplary embodiment.

In the above-described exemplary embodiment, the black unit 227 storing the black photosensitive drum 215 is provided so as to be attached to and detached from the process frame 213. However, as shown in FIG. 26, the black photosensitive drum 215 may be supported by the process frame 213 directly.

In this case, the black developer cartridge 214 is detachably attached to the process frame 213 on an upper side of the photosensitive drum 215, such that the developing roller 217 contacts the photosensitive drum 215 from above.

Also in this modification, similar effects and advantages of the above-described exemplary embodiment can be obtained.

What is claimed is:

1. An image forming apparatus comprising:

a body;

a first photosensitive member for color other than black color extending in a longitudinal direction;

a second photosensitive member for the black color extending in the longitudinal direction, the first and second photosensitive members being arranged side by side in a first direction perpendicular to the longitudinal direction;

an endless belt arranged so as to contact the first and second photosensitive members;

a drawer configured to hold the second photosensitive member and to be pulled from the main body in the first direction;

a first holding member configured to hold the first photosensitive member and be detachably attached to the drawer, the first holding member which is attached to the drawer being configured to be movable between a contact position in which the first photosensitive member contacts the endless belt and a separated position in which the first photosensitive member is separated from the endless belt; and a separation mechanism configured to press the first holding member and move the first holding member from the contact position to the separated position.

2. The image forming apparatus according to claim 1, wherein the first holding member includes a first end portion and a second end portion opposite to the first end portion in the longitudinal direction, the separation mechanism presses the second end portion.

3. The image forming apparatus according to claim 2, wherein the separation mechanism includes a reciprocating member movable to reciprocate along the first direction, the first holding member includes a pressed portion which is provided at the second end portion of the first holding member and is configured to be pressed by the reciprocating member, the reciprocating member is movable between a first position in which the reciprocating member cancels pressing the pressed portion and allow the first photosensitive member to contact the endless belt, and a second position in which the reciprocating member presses the pressed portion and separate the first photosensitive member from the endless belt.

4. The image forming apparatus according to claim 3, wherein the image forming apparatus has a monochrome mode for forming a monochrome image and a color mode for forming a color image, the reciprocating member is positioned at the first position in the color mode, and the reciprocating member is positioned at the second position in the monochrome mode.

5. The image forming apparatus according to claim 3, wherein the reciprocating member include a first guide portion configured to guide the pressed portion.

6. The image forming apparatus according to claim 3, wherein the drawer includes a second guide portion configured to guide the pressed portion.

7. The image forming apparatus according to claim 6, wherein the second guide portion is configured to guide the pressed portion along a direction perpendicular to both the first direction and the longitudinal direction.

8. The image forming apparatus according to claim 2, wherein the first photosensitive member includes a first end portion closer to the first end portion of the first holding member and a second end portion closer to the second end portion of the first holding member, the first end portion of the first photosensitive member includes a support portion supported by the drawer.

9. The image forming apparatus according to claim 8, wherein the first photosensitive member is configured to swing around the support portion.

10. The image forming apparatus according to claim 2, wherein the second photosensitive member includes a first end portion closer to the first end portion of the first holding member and a second end portion closer to the second end portion of the first holding member, and the first end portion of the second photosensitive member is disposed outside the endless belt.

11. The image forming apparatus according to claim 1, further comprising a second holding member configured to hold the second photosensitive member and be detachably attached to the drawer.

12. The image forming apparatus according to claim 1, further comprising:

a first developing unit including a first end portion closer to the first end, portion of the first holding member and a second end portion closer to the second end portion of the first holding member, the first developing unit including:

a first developing roller disposed adjacent to the first photosensitive member; and a first developing coupling portion configured to transmit a driving force to the first developing roller, the first developing coupling portion being provided at the first end portion of the first developing unit; and a second developing unit including a first end portion closer to the first end portion of the first holding member and a second end portion closer to the second end portion of the second holding member, the second developing unit including:

a second developing roller disposed adjacent to the first photosensitive member; and a second developing coupling portion configured to transmit a driving force to the second developing roller, the second developing coupling portion being provided at the first end portion of the second developing unit, wherein the first developing roller is configured to swing together with the first photosensitive member.

13. The image forming apparatus according to claim 12, further comprising:

a first transfer member opposing the first photosensitive member via the endless belt, the first transfer member being urged in an urging direction toward the first photosensitive member; and a second transfer member opposing the second photosensitive member via the endless belt, the second transfer member being urged toward the second photosensitive member, wherein the first transfer member is positioned at a contact position when the first photosensitive member contacts the endless belt, and is positioned at a separated position located on a downstream side of the contact position in the urging direction when the first photosensitive member is separated from the endless belt.

14. The image forming apparatus according to claim 1, wherein a plurality of the first photosensitive members are provided in the image forming apparatus.

* * * * *